US011376479B2

(12) United States Patent
Johnson et al.

(10) Patent No.: US 11,376,479 B2
(45) Date of Patent: Jul. 5, 2022

(54) GOLF FLAGSTICK ACCESSORIES AND MODIFICATIONS

(71) Applicant: Falcon Golf, LLC, St. Louis Park, MN (US)

(72) Inventors: James Evan Johnson, Minnetonka, MN (US); James T. Hegedus, Maple Grove, MN (US); Douglas J. Christensen, Medina, MN (US); Peter R. Johnson, New York, NY (US)

(73) Assignee: Falcon Golf, LLC, St. Louis Park, MN (US)

( * ) Notice: Subject to any disclaimer, the term of this patent is extended or adjusted under 35 U.S.C. 154(b) by 0 days.

(21) Appl. No.: 16/852,379

(22) Filed: Apr. 17, 2020

(65) Prior Publication Data

US 2020/0330832 A1 Oct. 22, 2020

Related U.S. Application Data

(60) Provisional application No. 63/003,847, filed on Apr. 1, 2020, provisional application No. 62/958,365, filed on Jan. 8, 2020, provisional application No. 62/954,369, filed on Dec. 27, 2019, provisional application No. 62/858,688, filed on Jun. 7, 2019, provisional application No. 62/835,391, filed on Apr. 17, 2019.

(51) Int. Cl.

| | |
|---|---|
| ***A63B 57/00*** | (2015.01) |
| ***A63B 47/02*** | (2006.01) |
| ***A63B 57/40*** | (2015.01) |
| ***A63B 57/30*** | (2015.01) |

(52) U.S. Cl.
CPC ..... *A63B 47/02* (2013.01); *A63B 57/357* (2015.10); *A63B 57/40* (2015.10)

(58) Field of Classification Search
CPC ..... A63B 47/02; A63B 57/357; A63B 57/40; A63B 71/023
USPC ..... 473/173–177
See application file for complete search history.

(56) References Cited

U.S. PATENT DOCUMENTS

| | | | | |
|---|---|---|---|---|
| 979,313 | A * | 12/1910 | King et al. | |
| 1,402,026 | A | 1/1922 | Waddell | |
| 1,599,734 | A | 9/1926 | Wilson | |
| 1,673,852 | A * | 6/1928 | Underwood | A63B 57/405 473/177 |
| 1,676,954 | A | 7/1928 | Kannemann | |
| 1,776,161 | A | 9/1930 | Lockwood | |
| 1,826,641 | A * | 10/1931 | Waddell | A63B 57/357 473/177 |

(Continued)

*Primary Examiner* — Nini F Legesse
(74) *Attorney, Agent, or Firm* — Christensen, Fonder, Dardi & Herbert PLLC

(57) ABSTRACT

A ball lifting device having an elevator is attachable to a flagstick for enabling easy removal of a golf ball that is holed while putting with the flagstick in place in the cup. The elevator may be attached to a handle portion that extends up along the pole portion of the flagstick allowing the elevator to be raised by way of the handle portion. The handle portion may have a hook portion for hooking up with a golf club so that hand contact with the device is eliminated. The handle portion may be a thin member. The handle portion may be a tubular portion. The elevator may be spring loaded with the spring manually loaded by a golfer and released to eject the golf ball from the cup.

14 Claims, 36 Drawing Sheets

(56) References Cited

U.S. PATENT DOCUMENTS

| | | | | | |
|---|---|---|---|---|---|
| 1,829,283 | A * | 10/1931 | Kip | A63B 57/40 | 473/177 |
| 1,918,994 | A | 7/1933 | Stutz | | |
| 1,943,610 | A | 1/1934 | John | | |
| 2,596,682 | A | 5/1952 | Hartung | | |
| 3,180,644 | A | 4/1965 | Winquist | | |
| 3,310,026 | A | 3/1967 | Baird, Jr. | | |
| 3,348,797 | A | 10/1967 | Turbyfill | | |
| 3,543,603 | A | 12/1970 | Gley | | |
| 3,790,166 | A * | 2/1974 | Hamilton | A63B 57/357 | 473/177 |
| 3,792,861 | A | 2/1974 | Coleman | | |
| 3,874,665 | A | 4/1975 | McCulloch et al. | | |
| 3,897,059 | A | 7/1975 | McCulloch et al. | | |
| 4,114,879 | A | 9/1978 | Oiler | | |
| 4,290,603 | A | 9/1981 | Barnes | | |
| 4,360,200 | A | 11/1982 | English | | |
| 4,496,150 | A | 1/1985 | McGlew | | |
| 4,552,358 | A | 11/1985 | McGlew | | |
| 5,393,053 | A | 2/1995 | Wiese et al. | | |
| 5,451,045 | A | 9/1995 | Garske | | |
| 5,480,142 | A * | 1/1996 | Ackerman | A63B 57/357 | 473/178 |
| 6,113,503 | A | 9/2000 | Brookman | | |
| 6,409,609 | B1 | 6/2002 | Brezic | | |
| 8,740,716 | B1 * | 6/2014 | Mallonee | A63B 57/405 | 473/177 |
| 9,662,554 | B2 | 5/2017 | Skurow et al. | | |
| 10,471,316 | B1 | 11/2019 | Bartlett et al. | | |
| 2003/0157989 | A1 | 8/2003 | Porter | | |
| 2009/0137331 | A1 | 5/2009 | Hansen | | |
| 2012/0184387 | A1 * | 7/2012 | Schoppe | A63B 57/357 | 473/176 |
| 2012/0196691 | A1 | 8/2012 | Maclean | | |

* cited by examiner

Fig. 3A
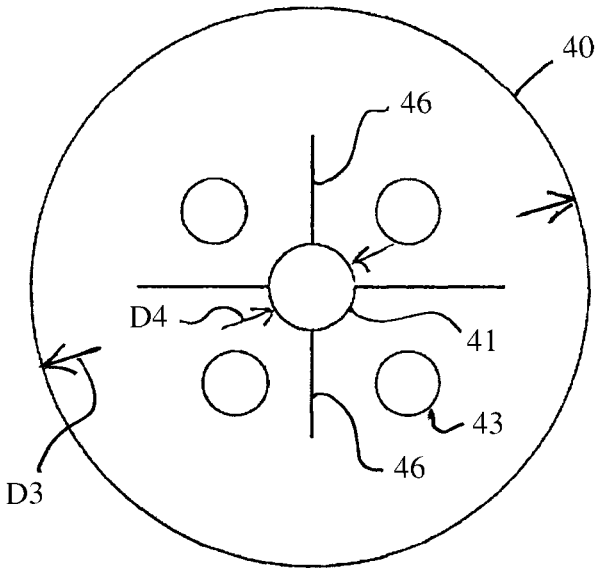
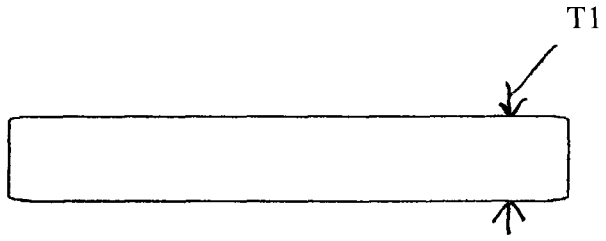
Fig. 3B

GOLF FLAGSTICK ACCESSORIES AND MODIFICATIONS

CROSS REFERENCE TO RELATED APPLICATIONS

This application claims priority to U.S. Provisional Application No. 62/835,391 to Johnson et al., filed on Apr. 17, 2019, entitled "Golf Flagstick Accessories and Modifications;" U.S. Provisional Application No. 62/858,688 to Johnson et al., filed Jun. 7, 2019, entitled "Golf Flagstick Accessories and Modifications;" U.S. Provisional Application No. 62/954,369 to Johnson et al., filed Dec. 27, 2019, entitled "Golf Flagstick Accessories and Modifications;" U.S. Provisional Application No. 62/958,365 to Johnson et al., filed Jan. 8, 2020, entitled "Golf Flagstick Accessories and Modifications;" and U.S. Provisional Application No. 63/003,847 to Johnson et al., filed on Apr. 1, 2020, entitled "Golf Flagstick Accessories for Minimizing Communal Contact Surfaces;" all of which are incorporated herein by reference.

BACKGROUND OF THE INVENTION

A significant part of the game of golf is putting. Greens provide a putting surface with holes placed in varying places on greens by the golf course operators. A tool is used to cut the hole in the green by removing a cylindrical bore of the green. The Rules of Golf require the hole to be 4.25 inches in diameter. Golf balls are 1.68 inches in diameter. A rigid cup, typically formed of metal, is firmly seated in the newly cut hole and positioned with the upper margin of cup an inch or more below the surface of the green. The circular edge of the hole, the lip, is turf. Damage to the lip is to be avoided. The cup has a central flagstick receiving hole at the bottom of the cup. Although the cups have the same 4.25 inch outer diameter as the inner diameter of the hole, the cup internal structure and dimensions may vary.

With regard to Flagsticks, the Rules of Golf provide:

1. The Flagstick a) Definition:

The Flagstick is a movable pole provided by the Committee that is placed in the hole to show players where the hole is. The flagstick includes the flag and any other material or objects attached to the pole.

b) Requirements

The flagstick must be:

a. circular in cross-section, and
b. less than or equal to 0.75 inches (19 mm) in diameter from a point 3 inches (76.2 mm) above the ground to the bottom of the hole and no greater than 2 inches (50.8 mm) in diameter at any point. Exceptions may be made for location indicators of a reasonable size attached to the flagstick.

The flagstick must not:

a. incorporate features, including materials, designed to act in a shock absorbing manner or have shock absorbing properties upon impact with the ball, or
b. have features or properties which are designed to unduly influence the movement of the ball, or
c. have attachments which are designed to allow a player to determine wind speed.

New golf rules effective in 2019 now allow golfers to leave the flagstick in the cup during putting without penalty. The stated purpose of the rule is to speed up play. Any equipment and accessories that accommodates play, expedites play, or otherwise improves the golf experience particularly where the flagstick is left in the cup during putting, would be well received by the golf community. Moreover, any innovations that help maintain the condition of the green, particularly in the area about the cup, would be well received by golfers and golf course personnel.

Golf ball ejectors and elevators that are part of flagsticks are known, particularly in the context of putting greens. Such devices typically do not integrate and complement existing regulation flagsticks that are in use on golf courses. Innovations and improvements on such devices to make them, for example, simpler with fewer parts, better performing, more function, less apt to cause damage to the green, easier to use by the golfer, easier to attach and/or remove from existing flagsticks would be welcomed by industry. Moreover, minimizing the golfer's contact with the device and/or flagstick would minimize potential of transfer of communicable diseases.

SUMMARY OF THE INVENTION

For a player that has the flag removed before putting, after making the put, the player can easily reach into the cup and retrieve his ball. The standardized golf hole size is 4.25 inches in diameter, and with the flag removed, a ball in the cup rolls into the central flagstick hole in the bottom of the cup. A golfer can readily retrieve the ball, typically by bending over and inserting essentially his or her entire hand into the cup, and with three or more fingers grabbing the ball at three or more points/regions of contact spaced around the ball, easily remove the centered ball without any significant thought or effort and with little risk of damaging the circular turf edge of the hole. For some golfers, particularly senior golfers, bending over repeatedly to pick up the golf ball can be problematic. In cases a grasping tool may be utilized that has, for example, a suction cup attached to the handle end of the golfer's putter; the golfer simply sticks the handle end of the putter with the grasping tool into the center of the cup engaging and grabbing the golf ball and then removes the ball without needing to bend over. Also, golfers occasionally utilize the head end of the putter, if suitably shaped, to lift or flip the ball out of the cup. This practice is not encouraged as it presents a risk of damaging the circular turf edge of the hole.

Where the flagstick is left in the cup, with a made putt the golf ball is positioned in the annular space between the flagstick and the sidewall of the cup and may be lodged at the bottom of the annular space. With the hole sized at 4.25 inches in diameter and the flagstick at 0.50 to 0.75 inches in diameter, the distance between the flagstick and the lip is about 1.75 to 1.875 inches. This leaves a clearance when the ball is in the annular space of about 0.07 to 0.20 inches.

When the golf ball enters the cup, the clearance between the flagstick and inner surfaces of the cup will be less depending on the wall thickness of the cup and the cup configuration. In instances, the golf ball can become lodged in the annular space in the cup. This reduced annular space at the lip and in the cup does not allow easy insertion of a hand for ball retrieval. In fact, removal of the golf ball can be challenging. The golfer needs to carefully reach down and use two fingers to try and grasp the golf ball on opposite sides of the golf ball and carefully remove the ball without damaging the lip. Alternately the golfer can remove the flag with one hand and reach down and grab the ball with the other hand, and then replace the flag. In some cases, with the right amount of finesse, a golfer can eject his ball from the hole when removing the flag. This is not an easy operation and is not reliable, the ball ejection is not controlled, the ball can roll several or many feet away from the golfer, and the practice can also cause damage to the hole. Course managers have considered securing flags into the cups to prevent this practice. Alternative ways and improvements to remove the golf ball in the annular space when the flagstick is left in the hole for putting while addressing the above issues would be well received. It would be advantageous to be able to utilize existing cups and flagsticks with any such improvements for minimizing the expense and effort associated with transitioning to the improvements. Moreover, it would be very advantageous if such improvements do not violate the rules of golf associated with golf equipment. For example, any such improvements should not change the normal ball path when a golf ball impacts a flagstick compared to the flagstick without the device, particularly during putting.

Golf ball ejectors and elevators that are part of flagsticks are known, particularly in the context of putting greens. Typically, any such prior art ejectors and lifting elevators include specialized componentry for cups and posts or flagsticks and are not amenable for use on modern golf courses with standardized holes and flags.

Improvements on such devices to make them, for example, compatible with existing golf holes with cups and flagsticks, simpler with fewer parts, better performing, such as less apt to cause damage to the green, easier to use by the golfer, and easier to attach and/or remove from existing flagsticks, would be welcomed by industry. Moreover, minimizing the golfer's direct hand contact with the device and/or flagstick would minimize potential of transfer of communicable diseases.

In embodiments, ball retrieval devices for removing a ball from a hole with the flagstick remaining therein, may be placed on existing, common, and standardized golf flagsticks. In embodiments, such devices do not alter the golf ball and flagstick impact dynamics. In embodiments, no permanent modifications are made to the existing cups and flagsticks when the devices are attached. In embodiments, the devices are easily attached and removed from flagsticks. In embodiments, the device fits entirely in the annular space between the flagstick and the cup, the earthen hole above the cup, and a handle portion extends up above the hole along the flagstick. In embodiments, the handle is thin walled polymer tube, made of a rigid polymer such as polycarbonate, extending approximately 2.5 to 3.5 feet above the surface of the green so that it can readily be grasped with a golfer's hand. In embodiments, a hook or loop may be on the handle to permit raising the device with, for example, a golf club. In embodiments, the handle connects to a disc shaped elevator with a central flagstick hole such that the handle and elevator slide upwardly and downwardly as a single integrated unit. In embodiments, the elevator can attach to a thin member, such as a thin strip, that extends upwardly along the flagstick with a hook on an upper end. The hook may be positioned a few inches above the green surface so as to not interfere with putted golf ball. The hook can then be hooked with a golf club to raise the device to a level to grab the golf ball or so that the golf ball rolls onto the green surface. In embodiments, a snap-on hooked portion with one or more hooks may attach to the tubular handle. In other embodiments the hooked portion may be unitary or permanently secured to a tubular portion of the tubular handle.

In embodiments, a polymer disk with a central hole sized for receiving the flagstick pole, and an outer diameter less than the inner diameter of the cup is attachable to the bottom of the flagstick, the disk having a diameter less than the diameter of the cup such that the flag with the attached disk is easily placed in the cup. The disk providing a lifting elevator such that when a put is made, any removal of the flagstick with a ball in the cup and on the disk will lift the ball out of the hole, the ball then rolling off the disk to the green surface where the golfer can easily pick it up. The disk can have a pair of criss cross slits at the central flagstick hole allowing the disk to be forced over the flagstick ferrule at the bottom of the flagstick allowing the disk to then seat on the top surface of the flagstick lower ferrule. No tools or additional components are utilized to attach and remove the lifting elevator from the flagstick. A central portion of the disk has a close fit to the flagstick with sufficient axial engagement of the disk with the flagpole to maintain the disk in a position with respect to the flagstick and cup such that the disk reliably lifts the golf ball when the flag is pulled. That is, the plane of the lifting elevator stays sufficiently perpendicular to the axis of the flagstick to retain the golf ball or balls thereon during lifting. In embodiments, the disk may have an upwardly facing concavity to retain the ball on the disk as the flagstick and disk are elevated out of the hole. The disk may be made of a polymer foam that retains its shape but is resiliently deflectable such that when the flagstick is placed on the green surface the disk deflects.

A feature and advantage of embodiments is that the polymer disk may be readily and economically injection molded from conventional polymers such as polyethylenes and nylons for example. Foaming agents may be added to the process. The foamed polymer may be open cell or closed cell.

A feature and advantage of embodiments is that the polymer disk may easily be attached and removed from the flagstick, allowing easy retrofitting of existing flagsticks.

A feature and advantage of embodiments is the device in no way alters or effects play.

A feature and advantage of embodiments is the device presents minimal or no risk of damaging the circular turf edge of the hole when the ball is removed.

A feature and advantage of embodiments is a ball lifter on a flagstick that has means for prevention of damage to the green if the flagstick is pulled and the flagstick end with the ball lifter is dropped on the green surface. In embodiments a blunt circumferential edge prevents the ball lifter from denting or otherwise cutting into the green surface. In embodiments, the ball lifter is deformable to absorb any shock when the ball lifter impacts the green surface. In embodiments the ball lifter may be secured directly to the flagstick or secured to a tubular handle that encompasses the flagstick. In embodiments the ball lifter has ball capture region between an axial center of the ball lifter and a periphery of the ball lifter such that a ball that is elevated vertically in the ball lifter remains in the ball capture region.

In embodiments, a ball removal device comprises a lifting portion that may be configured as a bottom bowl portion sized to be received in the cup with a tubular shaft that extends upwardly from the center of the bowl portion providing a manual handle portion. The bowl sized to fit within the golf cup around the flagstick, for example about 4.0 inches or less, and to seat at or toward the bottom of the flagstick, the tubular shaft and bowl sized to slidingly fit around the flagstick while providing minimal increase in the external diameter of the flagstick. The tubular shaft extending upwardly on the flagstick to minimize or eliminate the golfer's need to bend over to grasp the tubular shaft, in embodiments the top margin of the device may be 2.5 feet or more in length. Whereby when installed on the flagstick, after a putt is made with the flagstick in the hole, the putter may grasp the tubular shaft, lift the device upwardly with the golf ball retained in the bowl, to a height sufficient that the golfer may then grab the golf ball in the bowl with his other hand, again without the need to bend over. The device may then be released falling back to a seated and resting portion at the bottom of the flagstick. The bottom bowl portion may have golf ball seating regions or seats spaced around the bowl by way of recesses arranged around the center of the bowl or by upwardly extending ribs that define the regions. The seating regions retaining the ball therein as the bowl is raised, so that the ball does not roll around the bowl allowing for easier grasping by the user.

A feature and advantage of embodiments is a manual device to raise golf balls in a golf cup when the flag is in place, the device comprising a tubular handle that extends up the pole with a ball elevator on the bottom of the tubular handle, the elevator resting on the flagstick ferrule, the tubular handle having a upper end positioned at a mid region of the flagstick easily graspable without bending over for raising the device by grasping and raising the tubular handle with one hand raising the ball elevator upwardly so that a ball in the elevator may then be grasped by the golfer's other hand. In embodiments an upper end portion may be painted red or be a color that contrasts with the color of the flagstick providing a circumferential stripe extending around the flagstick at approximately the lengthwise middle portion of the flagstick. The handle then being visible to golfers taking approach shots from off the green and making the flagstick more visible than it would be without the stripe. The strip further providing a visual reference indicator at approximately three feet above the cup that can further provide visual information to the golfer by comparing the length of the flagstick above the strip to the flagstick below the strip to indicate whether the cup is positioned at a portion of the green not directly visible to the golfer. In embodiments, the tubular handle may have a reflective portion that reflects laser radiation from laser rangefinders thereby alleviating the need to put such reflectors elsewhere on the flagstick.

It has been discovered that the device performs surprisingly well with tubular shaft formed of a polymer having a wall thickness of about 0.012 inches or less and with an inside diameter of about 0.010 greater than the outside diameter of the flagstick resulting in a diameter increase of only about 0.035 inches or less on the flagstick. Although such a tubular wall thickness is minimal, surprisingly, it has more than adequate strength to perform its function, due in part to the skeletal support provided by the flagstick. The tubular handle cannot be meaningfully deformed or stressed while on the flagstick other than very modest tensile loading while lifting the golf balls. The inventors have observed in embodiments such a tubular handle does not act in a shock absorbing manner or have shock absorbing properties upon impact with the ball, nor does it unduly influence the movement of the ball, and does not alter the probability of the ball going into the cup.

In embodiments of a golf ball lifting device, a tubular handle is positioned on a flagstick with a ball lifter portion attached to the lower end of the tubular handle, the ball lifter portion sized to fit within the cup and to hold golf balls that roll into the cup, allowing the golf balls to be raised by sliding the tubular handle upwardly on the flagstick. The tubular handle increasing the diameter of the flagstick, in embodiments, not more than 0.055 inches. The tubular handle increasing the diameter of the flagstick, in embodiments of not more than 0.045 inches. The tubular handle increasing the diameter of the flagstick, in embodiments of not more than 0.050 inches. The tubular handle increasing the diameter of the flagstick, in embodiments of not more than 0.036 inches. In embodiments, the flagstick has a diameter of 0.50 inches with a total diameter of the flagstick with the tubular handle of 0.535 inches. In embodiments, the lifting device is placed on a flagstick with diameter at the cup of about 0.375 inches and the total diameter is less than 0.500 inches. In embodiments, the tool is placed on a flagstick with diameter at the cup of 0.375 and the total diameter is less than 0.410 inches.

In embodiments, a ball lifting device with a tubular handle positioned on a flagstick may be formed of a polymer and may have an elongate slit or slot extending the entire length of the device. The slit or slot on the tubular handle sized to be less than the diameter of the flagstick, and openable to receive the flagstick therein. In embodiments, the device may be continuous circularly with no slits or gaps whereby the device may then be installed over the upper end of the flag. In embodiments, the device may be formed of two clam shell portions configured as halves that connect together to clamp around the flag pole. The two clam shell halves secured together with threaded fasteners, glue, unitary connector portions of the clam shell halves, plastic cable ties or other means.

In embodiments of the invention, a flagstick has a central solid core portion of a constant diameter extending from a ferrule that plugs into a cup at least four feet upwardly, in embodiments to the top of the flag. A tubular member extends over the inner core member and is slidable thereon. The tubular member may extend a distance below the flag such that the tubular member operates as a handle, a ball lifter is on the lower end of the tubular member positioned to be near the bottom of the cup when such that the tubular member with the ball lifter may be raised when a ball is in the cup, resting on the ball lifter, sufficient for a user to grab the ball without any or with minimal bending over. The tubular portion may have minimal diameter above the lifter to the position of the green surface when the flagstick is in the cup, and then a taper to a greater diameter that is maintained a distance toward the flag. In embodiments, the flag may be on the central solid core portion, in embodiments the flag may be on the top of the tubular member. Where the flag is on the tubular member, the top end of the tubular member may be solid. In such embodiments stops may be provided such that the tubular member can only be raised a certain distance so that it is not removable from the central core portion during use.

In embodiments, the central core portion is 0.350 inches in diameter to 0.400 inches. In embodiments, the central core portion is 0.365 inches in diameter to 0.390 inches in diameter. In embodiments, the tubular portion may add strength resisting bending in the wind.

In embodiments, the tubular portion of the device has an outside diameter of 0.75 inches or less. In embodiments, the device is installed on a flagstick with varying diameters. The tubular portion may have elongate slits to accommodate the changing diameter of the flagstick as the device is raised.

A feature and advantage of embodiments, is that the retrieval of the golf ball from the annular space is accomplished without bending over, without removing the flag, and without any other accessories, such as a grasping device on the end of the putter.

A feature and advantage of embodiments is the device presents minimal or no risk of damaging the circular turf edge of the hole when the ball is removed.

In embodiments, a golf flagstick has a pole portion with an inner core and an outer telescoping section, the inner core having the cup ferrule attached thereto, the outer telescoping section having an elevator for receiving a putted ball when the flagstick is left in the hole while putting and for lifting the ball out of the hole. The maximum diameter of the pole portion being 0.75 inches. The clearance between the inner core and outer telescoping section may be a few thousandths of an inch or more. Either the inner core or the outer core may be the uppermost portion of the pole portion. The elevator portion may be removable or fixed to the outer telescoping section. The outer telescoping section with the elevator attached thereto seating on or just above the ferrule. Each of the inner core and outer telescoping section may be formed of fiberglass, steel, or other rigid materials. In embodiments, where the inner core is the uppermost portion of the flagstick and receives the flag, the telescoping portion extending at least about 2.5 feet above the ball cup ferrule. In embodiments, the elevator is donut shaped, attachable and detachable to the outer telescoping section. In embodiments, the outer telescoping section having a seating portion with an upwardly facing shoulder that can removably receive an elevator thereon. In embodiments the seating portion can be conically shaped with the taper pointing upward. The elevator may have an inner and downwardly facing conical surface that cooperates with the seating portion to fixedly seat the elevator.

In embodiments, a golf flagstick has a pole portion with a lower pole portion that has a hollow core, the lower portion having a ferrule for being received by the hole cup, a ball elevator movably positioned on the flagstick lower portion above the ferrule, the ball elevator having a seating position above the ferrule. The flag stick further having a handle portion positioned at an elevated portion of the pole portion at least three feet from the ferrule, the handle connecting to an extending member, such as an inner rod or cable that extends through the hollow core down to the lower portion of the ball elevator. The extending member operatively connected to the ball elevator. The connection may be by way of a slot in the lower portion of the flagstick with the extending member attached to the elevator such that upward axial motion of the handle and extending member raises the elevator. Alternatively, the extender member may have magnets on a lower end of the extender member and the ball elevator may comprise magnetically attractable material such as steel. Whereby when the magnets are raised by elevating the extender member the elevator on the exterior of the lower pole portion moves upwardly.

In embodiments of the invention, a magnet or ferrous piece may be placed on the top end of the golf ball lifting device and the steel shaft of the club or a magnet, such as a magnet attached to the top tip of the putter can be utilized to connect with the lifting device and raise the lifting device without touching the golf ball lifting device or flagstick. Such an arrangement may provide less of a projection from the flagstick which could in rare cases cause a ball striking the flagstick to bounce away from the hole. In embodiments, the lifting device has the hook below the green level. The putter handle or other convenient tool may be inserted into the cup to capture the hook and to then raise the golfball lifting device. In embodiments, rather than a hook a magnet or ferrous material may be at the top of the golfball lifting device which is below the green level. A putter with a magnet on the end of the putter handle can be used to engage the golf ball lifting device at the magnet or ferrous material and raise the golf ball lifting device with the golfball therein without touching with one's hand the flagstick or golfball lifting device.

A feature and advantage of embodiments is the device presents minimal or no risk of passing communicable diseases through hand contact with the flagstick or golfball lifting device.

In embodiments, the handle may be a tubing portion on the exterior of the flagstick positioned at a mid portion of the flagstick of slidingly engagement therewith and connecting to the extender by way of an exteriorly exposed slot extending axially through a lower portion of the pole.

In embodiments, a golf ball ejector device comprises a handle extending upwardly from a an annular ejector mechanism. The handle may be used to actuate the ejector mechanism such as by charging an ejector spring. In embodiments the golf ball may be ejected from the cup by the golfer utilizing the handle to load and release an elevator charge spring. The handle may be spring loaded to return to a normal position. In embodiments downward pushing of the handle may operate an elevator raising mechanism to eject or discharge golf balls in the hole.

BRIEF DESCRIPTION OF THE DRAWINGS

FIG. 3A is a plan view of a disk fittable on a flagstick for lifting a golf ball out of the cup after putting.

FIG. 3B is a side elevation view of the disk of FIG. 3A.

DETAILED DESCRIPTION

Figure 1:
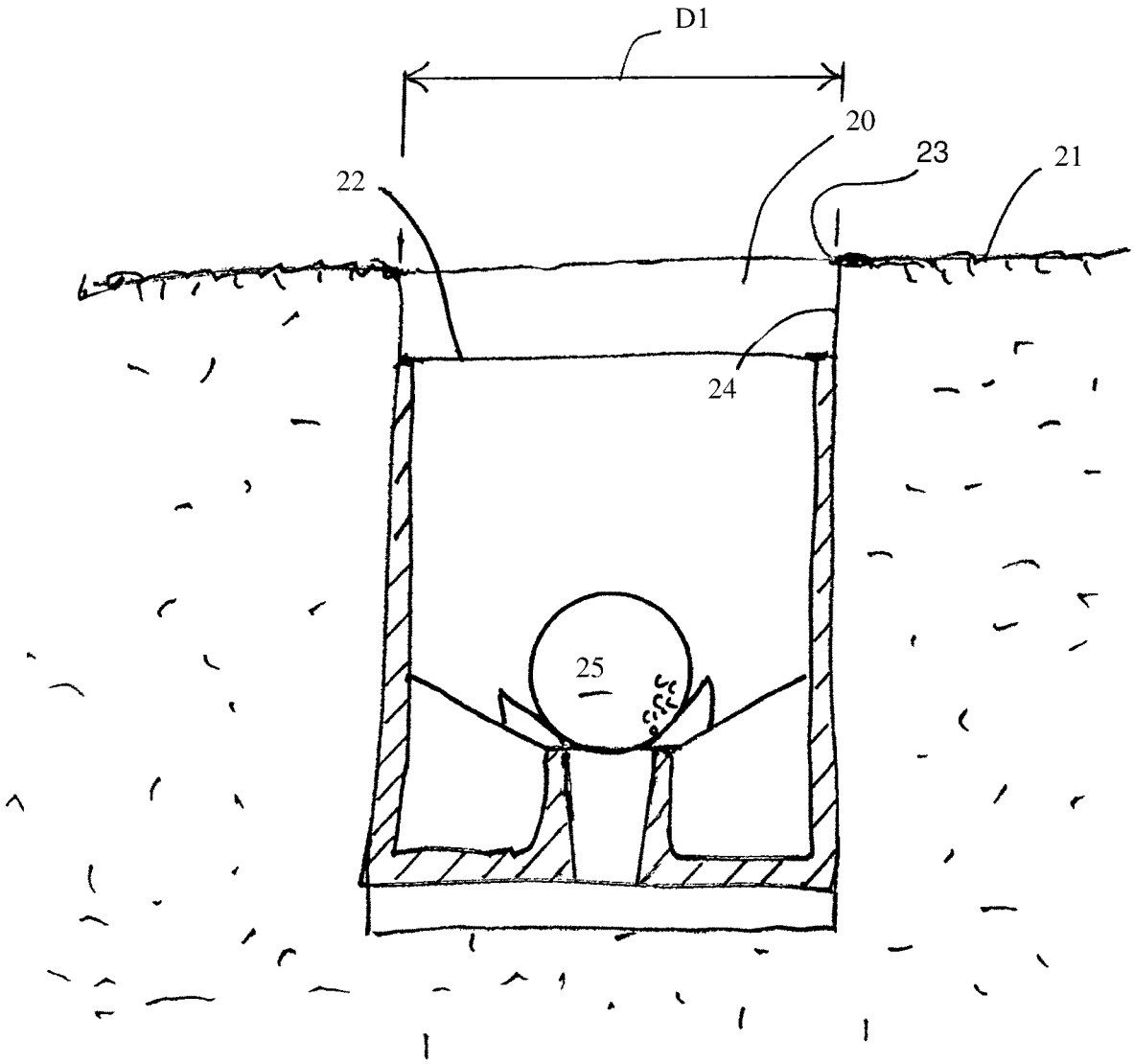
Fig. 1 Prior Art
FIG. 1 is a cross section of a prior art golf hole with the flagstick not in place and a golf ball to be removed.
Figure 2:
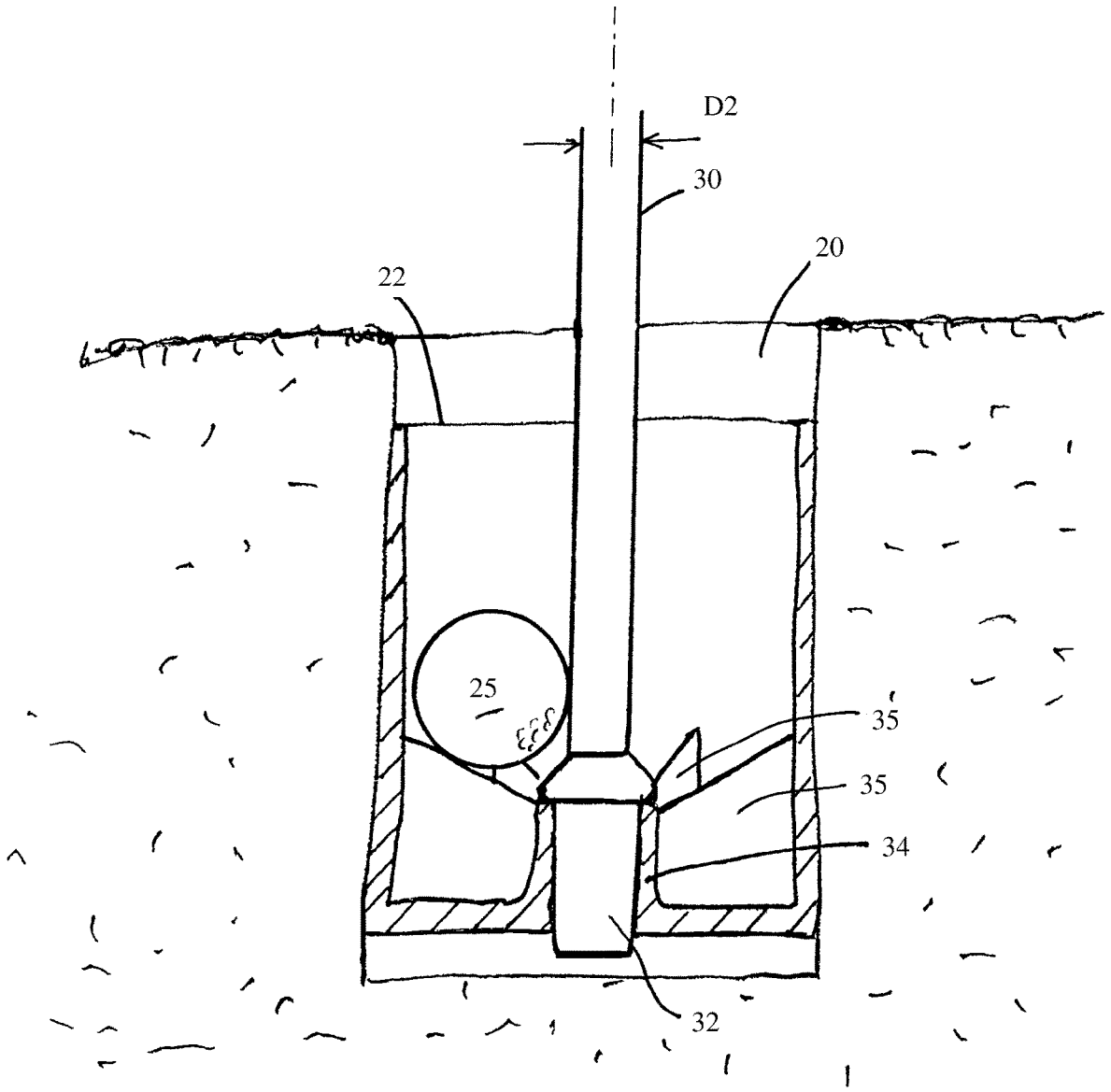
Fig. 2 Prior Art
FIG. 2 is a cross section of a prior art golf hole with the flagstick in place and a golf ball to be removed illustrated the limited access to the ball.

FIGS. 1 and 2 illustrate a prior art standardized modern golf hole 20 in a green surface 21 such as found on regulation nine and eighteen hole golf courses. The hole 20 has a diameter D1 of 4¼ inches with a metal cup 22 positioned in the hole at least 1 inch below the green surface providing a lip 23 and an earthen interior surface 24 above the metal cup. FIG. 1 illustrates the relative ease of access of a golf ball 25 in the cup without a flagstick. FIG. 2 illustrates the limited access to the golf ball with a standardized flagstick 30 in place, the ferrule 32 seated in the socket 34 of the cup 22 with gussets 35 supporting the socket. Such conventional standardized flagsticks have an outside diameter D2 of 0.50 to 0.55 inches and a height of six to seven feet, or more.

Figure 4:
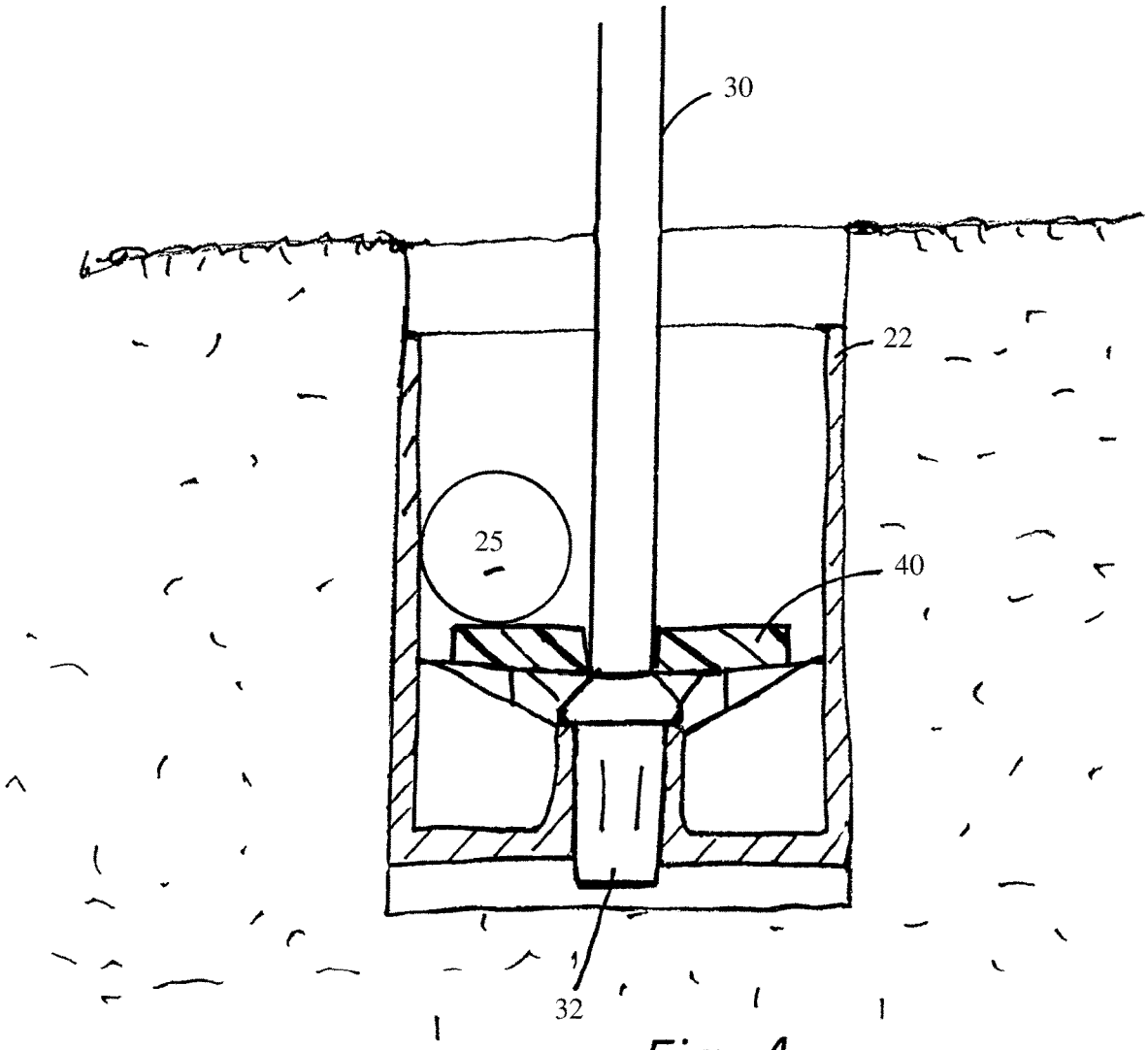
FIG. 4 is a cross section of a golf hole with the disk of FIG. 3 in place on the flagstick.

FIGS. 3A, 3B, and 4 illustrate an embodiment with a disk-shaped elevator 40 formed of a polymer that may be attached to an existing flagstick 30 over the ferrule 32. The diameter D3 of the disk may be 3.25 inches, the central hole 41 may have a diameter D4 of 0.55 inches, the drain holes 43 may have a diameter D4, for example, 0.25 to 0.5 inches in diameter, or in an embodiment 0.325 inches. The disk may be puck shaped with a thickness T1 of 0.75 inches, for example. Dimensions may vary and may be within 10% of the specified dimensions. Slits 46 may extend from the central hole to facilitate application to the flagstick. The disk 40 may be forced over the ferrule end of the flagstick and is resiliently retained thereon or may simple seat on the ferrule 32. The disk diameter is great enough to reliably lift balls in the cup but not so wide as to impede replacing the flagstick in the hole when it has been removed. The flagstick conforms with USGA recommendations and is about 7 feet or taller. The polymer may be a semi rigid foam polymer that is deformable but returns to its' original shape.

Figures 5A, 5B, 5C:
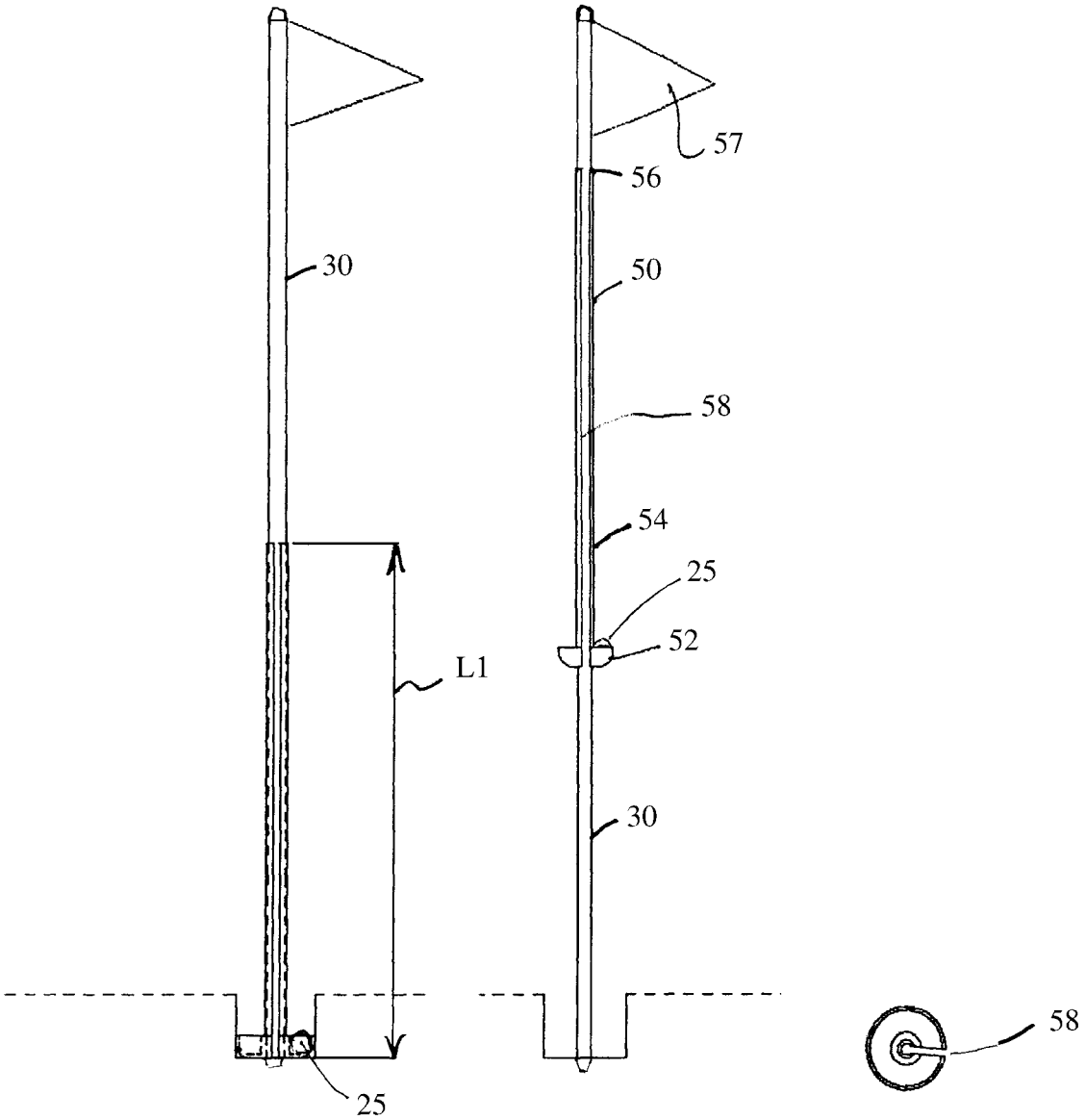
FIG. 5A is a cross section elevation view of a golf hole with a flag in place and a ball lifting device on the flagstick for removing a putted golf ball.
FIG. 5B is an elevation view of the flagstick of FIG. 5A with the ball lifting device lifted elevating the ball.
FIG. 5C is a plan view of the ball lifting device of FIGS. 5A and 5B.
Figure 6:
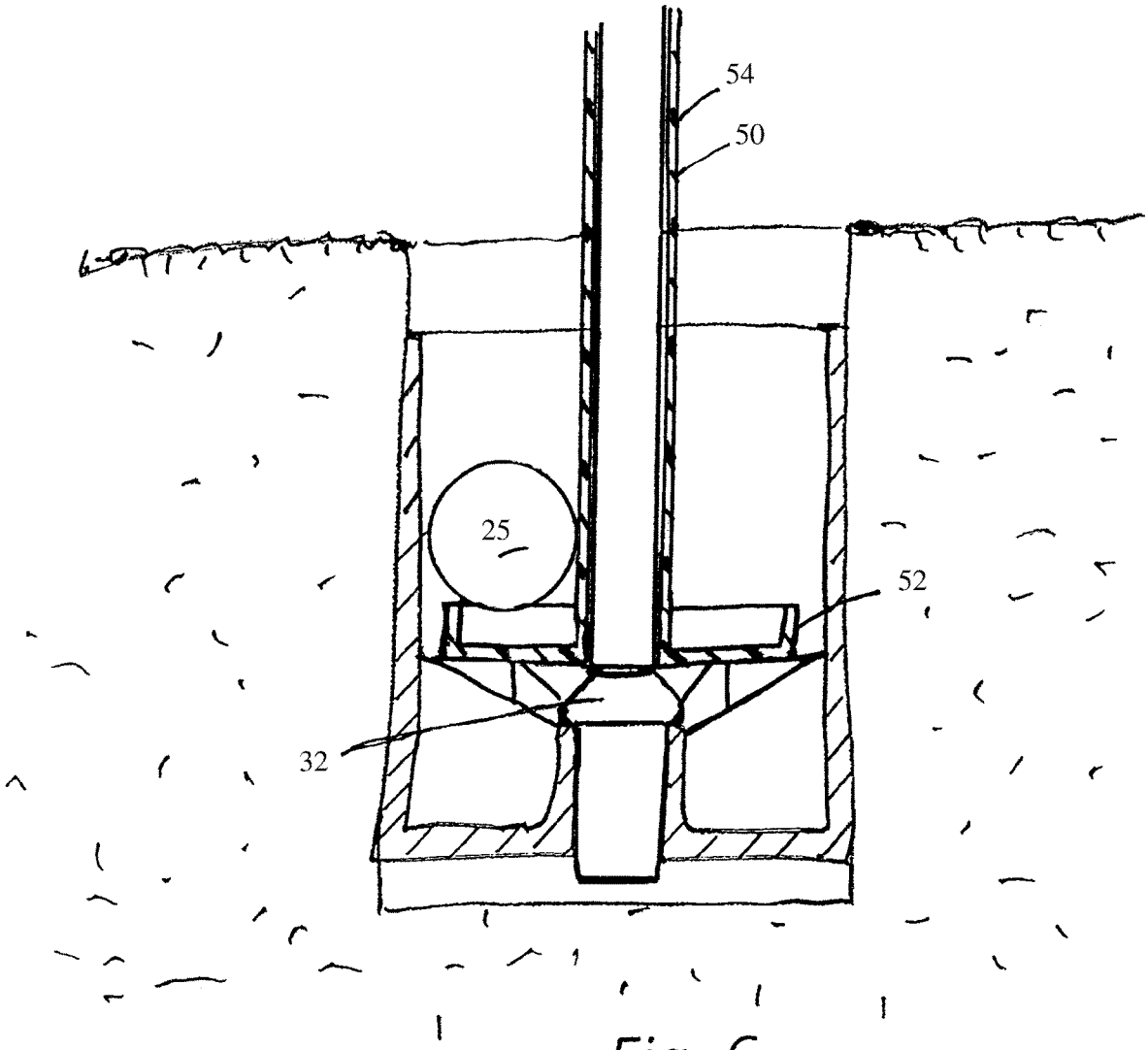
FIG. 6 is a detailed cross section of the device of FIG. 5.

FIGS. 5A-6 illustrate an embodiment with a ball removal device 50 that may be added to an existing flagstick 30 in which a bowl shaped elevator 52 is unitary or integrated with a tubular portion 54 that operates as a handle for manually raising the elevator 52 after a putt is holed to a height that the ball may be easily grasped, see the flagstick 30 of FIG. 5B. The device length L1 is suitably about 2.5 fee to 3.5 feet. Ideally the length will allow easy access to the golf ball 25 in the bowl without the top 56 of the tubular portion 54 contacting the flag 57. A slot 58 allows the device to be snapped onto the flag.

Figure 7:
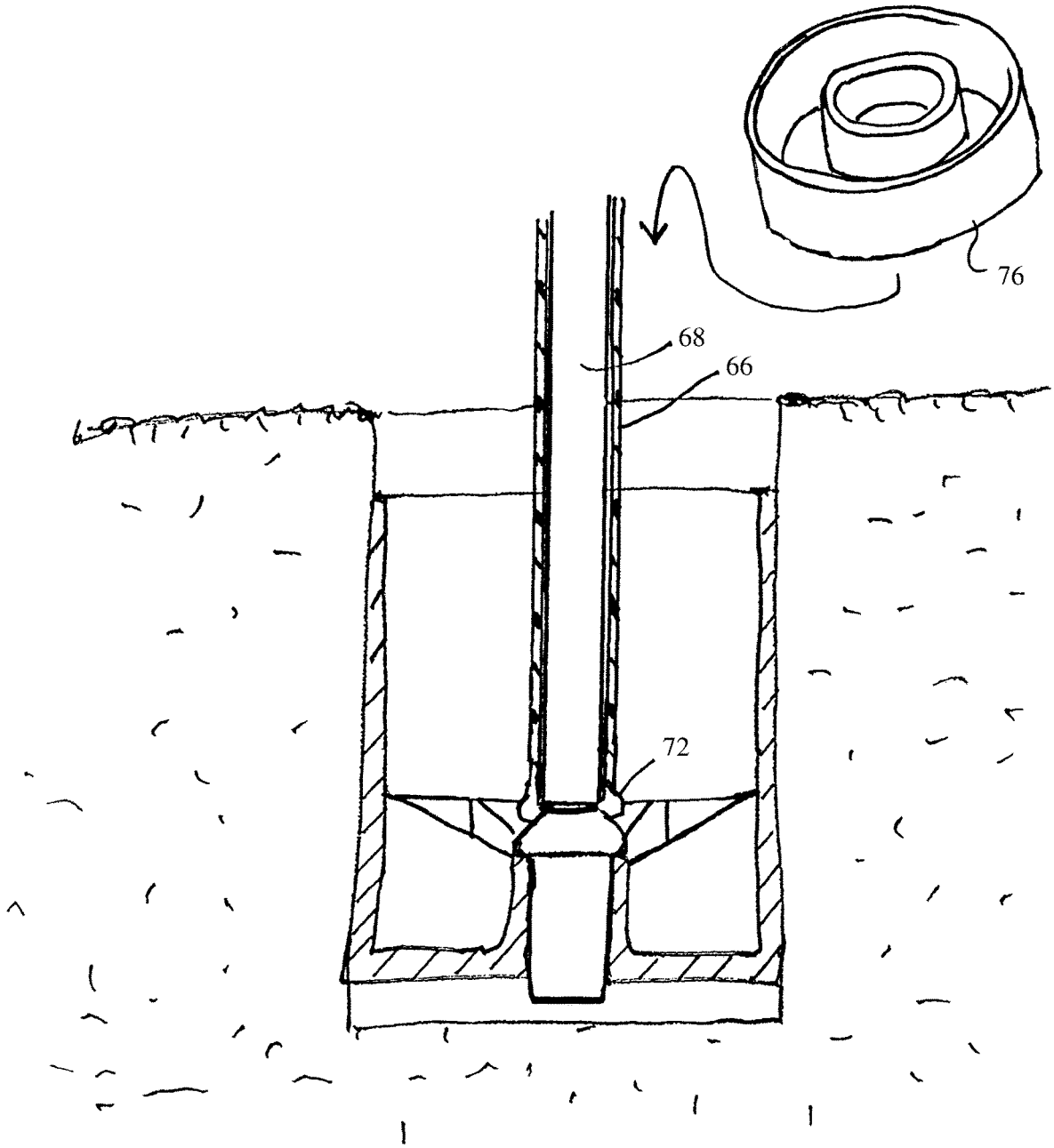
FIG. 7 is a cross section of a modified flagstick with a telescoping outer tubular portion having a seating portion for receiving an elevator.

FIG. 7 illustrates an embodiment in which the flagstick 64 has an integrated tubular portion 66 that extends around a core portion 68. Not shown, either component may be the component to which the flag is attached. Where the flag is attached to the core portion the tubular portion only extends up the core to a position below the flag. Where the flag is attached to the tubular portion, the core portion 68 is not exposed. The tubular portion has a seating portion 72 onto which an elevator 76 may be placed to perform similar to the device of FIGS. 5A-6.

Figure 8:
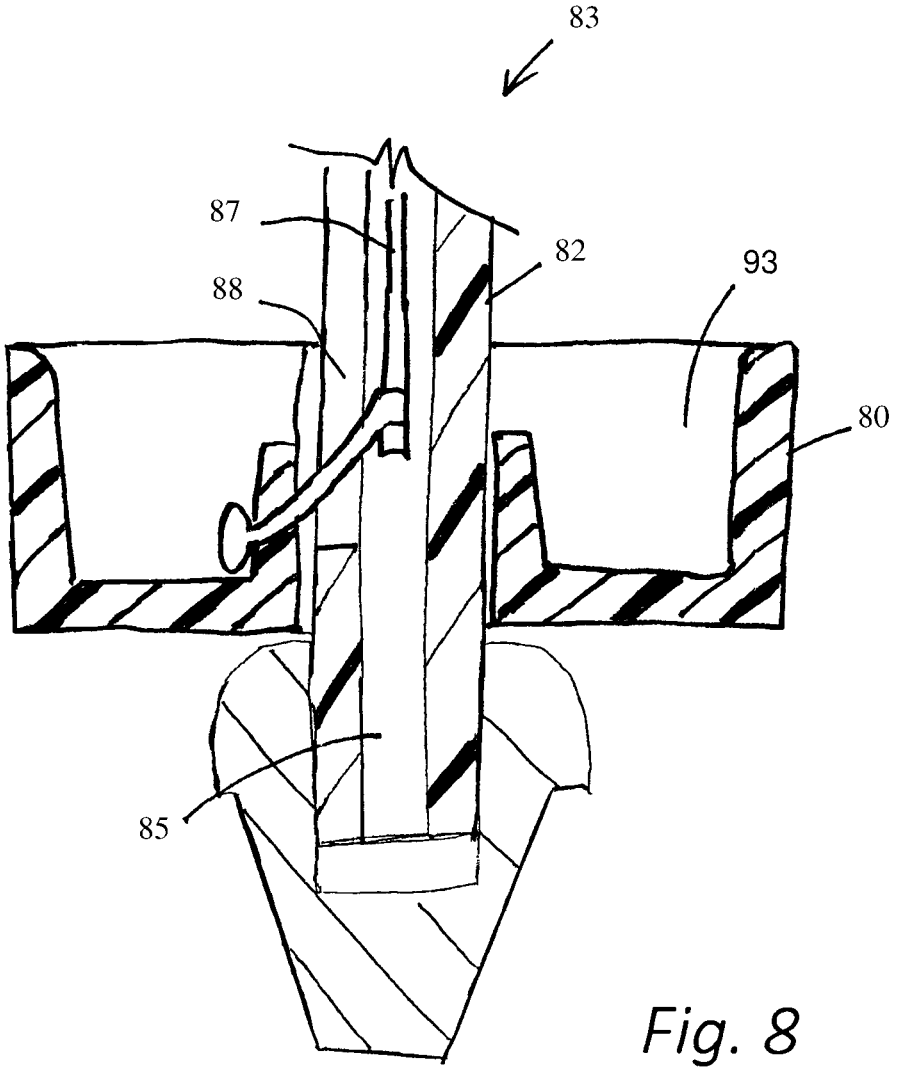
FIG. 8 is a cross section of the lower portion of a pole portion of a flagstick with an elevator slidably connected thereto and connecting to a central actuation member.
Figure 9:
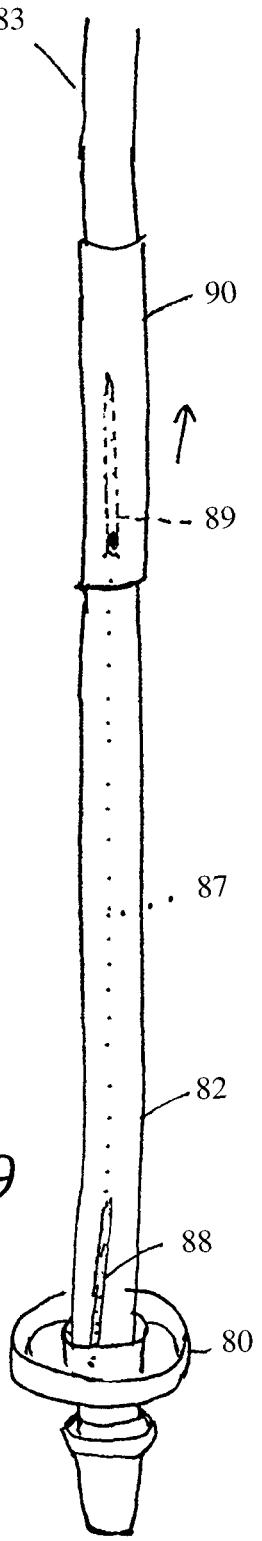
FIG. 9 is a perspective view of the flagstick and elevator of FIG. 8 with the elevator in the lowered position.
Figure 10:
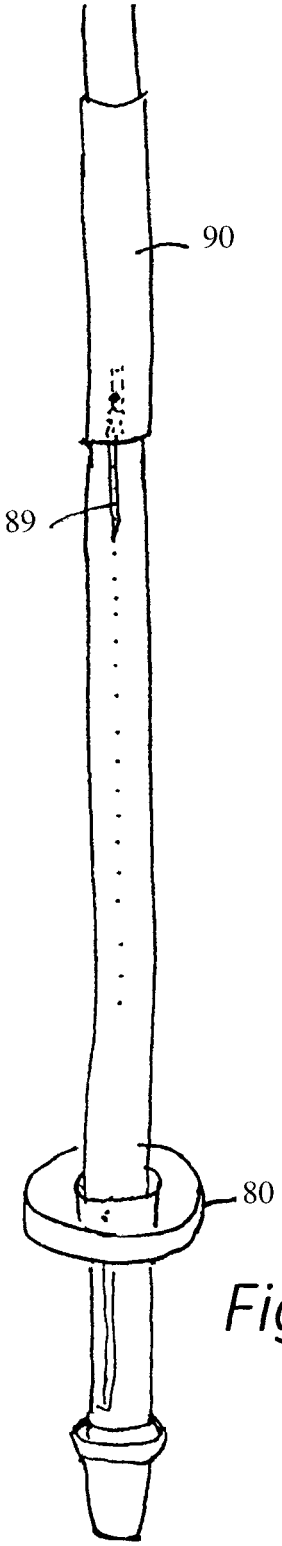
FIG. 10 is a perspective view of the flagstick of FIG. 9 with the elevator in an elevated position.

FIGS. 8-10 illustrate an embodiment in which the elevator 80 is slidingly mounted to the pole portion 82 of the flagstick 83. The pole portion has a hollow core 85 allowing an actuation member 87 to extend from the elevator through a slot 88 in the pole portion 82 up through the hollow core to another slot 89 where it can attach to a handle 90. Raising the handle raises the elevator lifting the ball out of the hole. The elevator may be shaped to allow the ball to escape from the elevator when raised out of the hole, similar to the embodiment of FIGS. 3 and 4, or may have a concavity 93 for retention of the ball in the elevator 80 until the ball is grasped.

Figure 11:
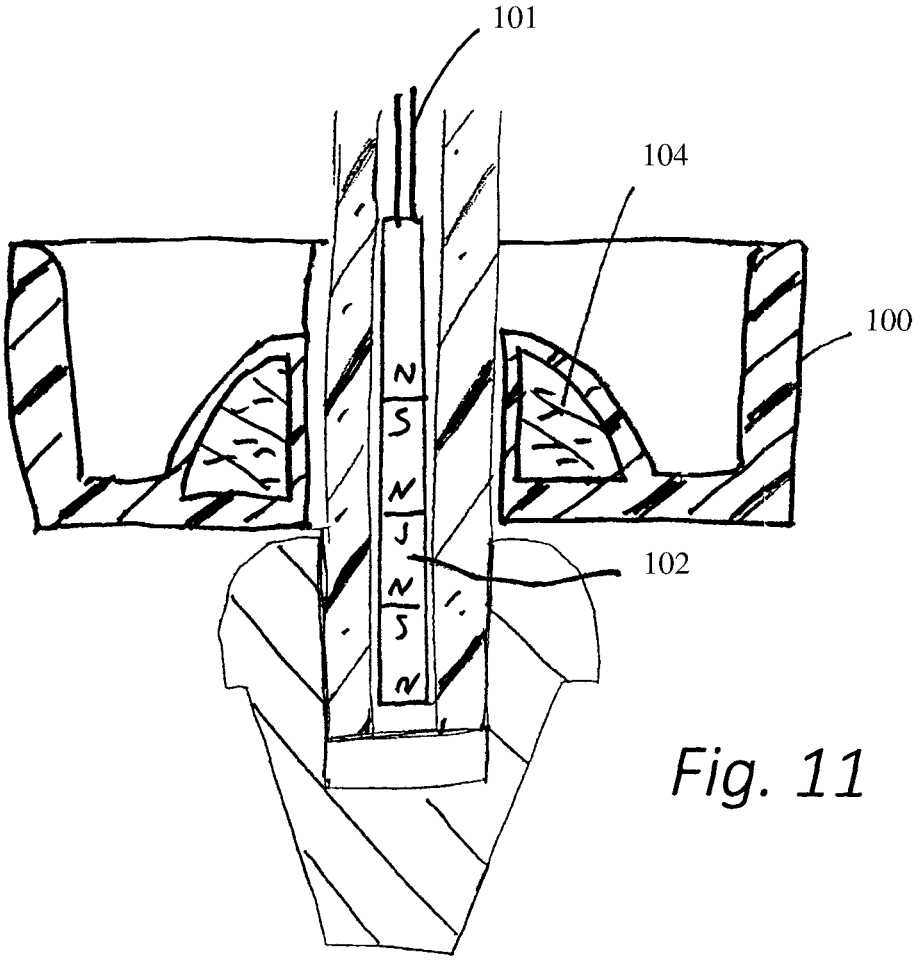
FIG. 11 is a cross section of the lower portion of a flagstick with an elevator and with an actuator with magnets coupled to the elevator.
Figure 12:
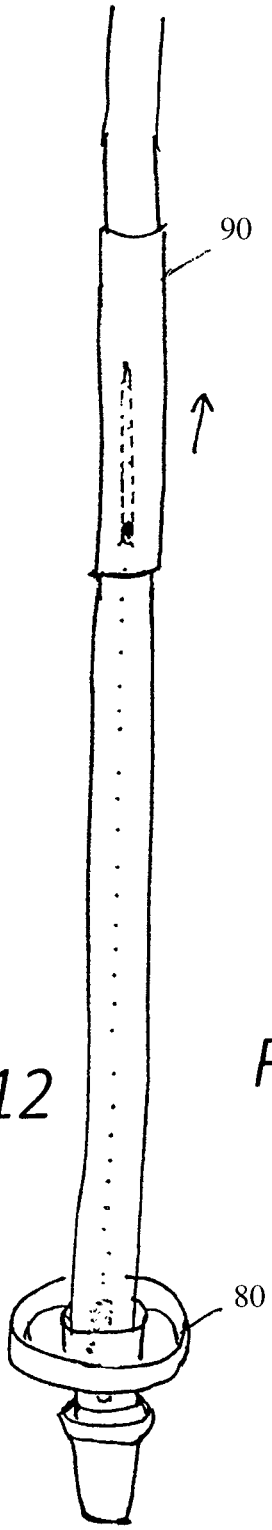
FIG. 12 is a perspective view of the flagstick of FIG. 11 in a lowered position.
Figure 13:
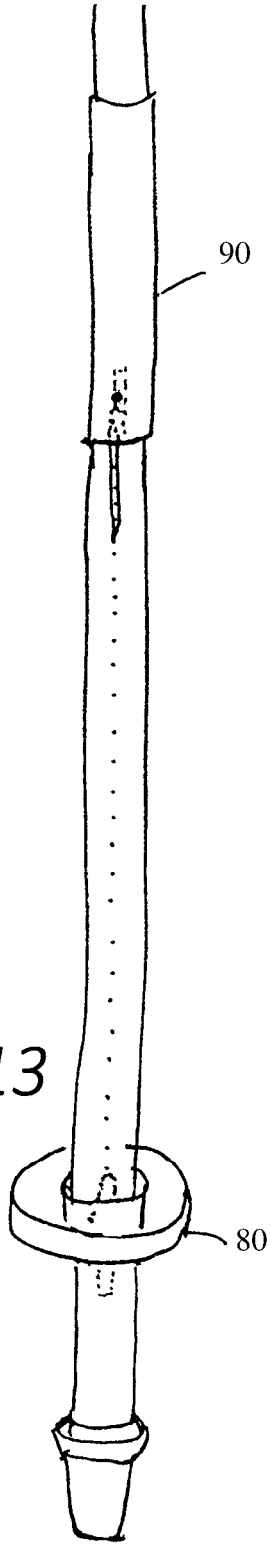
FIG. 13 is a perspective view of the flagstick of FIG. 11 and FIG. 12 in a raised position.

FIGS. 11, 12, and 13 illustrates an embodiment in which the actuation member 90 does not directly connect to the elevator 100, rather it is magnetically coupled. The actuation member 101 has magnets 102 connected thereto and the elevator has material 104 that couple to the magnets such as iron, steel, or additional magnets. The magnetically attractable material 104 may be embedded in the polymer of the elevator or otherwise securely attached thereto. The upper end of the actuation member attaches to a handle 90. Raising the handle raises the magnets and by way of the magnetic coupling urges the elevator to raise lifting any ball thereon upwardly out of the hole.

The flagsticks illustrated herein will typically have a pole portion with a diameter of between 0.50 inches and 0.75 inches and may be of standard length of typically 7 feet. The elevators and handles may be formed of injection molded polymers. The flagsticks may be formed of fiberglass, carbon fibers, or metals. Embodiments include a ⅜ inch flagstick with a ball lifting device thereon.

Referring to FIGS. 14-15 and 18-23, in an embodiment, a flagstick 130 seated in a cup 132 in a green 134 having a green surface 136 and with a ball lifting device 140. The ball lifting device has a tubular handle portion 142 and an elevator portion 144. The lifting device has a upper handle portion 146 that may be a different and contrasting color than the rest of the lifting device and the flag. Such a contrasting member gives a definitive indication of the presence of the lifting device and an indication to the golfer of where to grasp the device. Also, the coloration may be selected to provide enhanced visibility of the flag and information to a golfer off the green as to how much of the flagstick is visible from the golfer's position. Referring also to FIGS. 18-23, the tubular handle portion may be a polymer or a metal tubing. A thin polymer of 0.010 to 0.025 inches wall thickness formed of propionate plastic and 36 inches long has been shown to provide good performance. In embodiments the tubular handle has a wall thickness of 0.010 to 0.017 inches. The tubular handle may be formed of propionate plastic and 36 inches long and has been shown to provide exceptional performance. In embodiments the handle portion is 24 to 48 inches long. In embodiments, the handle portion is 30 to 40 inches long. In embodiments the handle portion is 30 to 38 inches long. In embodiments the elevator is formed of Black Lustran with a 3.55 inch diameter. In embodiments the diameter is 3.55 inches plus or minus 0.30 inches. The edge periphery 149 has a blunt ¼ inch surface to prevent green damage when laid on the green surface. In embodiments the diameter of the tubular handle portion above the elevator at the green level when the lifting device is seated on the top of the ferrule 164.

Referring to FIGS. 16, 17, and 25A-25D, a flagstick 150 with a thickened midportion 152 and a ball lifting device 156 adapted for same is illustrated. Such a flagstick is often considered and termed a "tournament" flagstick. The lifting device tubular handle 164 may be conformingly shaped to the bottom of the flagstick when the device is seated on the bottom of the flagstick, for example on the ferrule 159. Slits 162 on the tubular handle 164 allow the tubing to expand as it is raised and the slitted portion 164 is raised to the lowered tapered portion 166 of the flagstick. The resilience of the polymer allows the shape to expand and contract as it is raised and lowered. The special shape may be formed from a preform 163 shown with suitable dimensions and having with a mid portion 165 heat shrinkable such that at the region of the flagstick immediately above the green surface, the tubing has a tight conforming fit to minimize any effect on golf ball impact. In embodiments the inside diameter of the tubular handle is 0.605 inches, plus or minus 0.03 inches. The inside diameter D9 of the flared portions 168 may be, for example, 0.765 inches, plus or minus 0.15 inches. The inside diameter D10 of the central portion 168.5 may be 0.510 inches plus or minus 0.05 inches.

Figure 14:
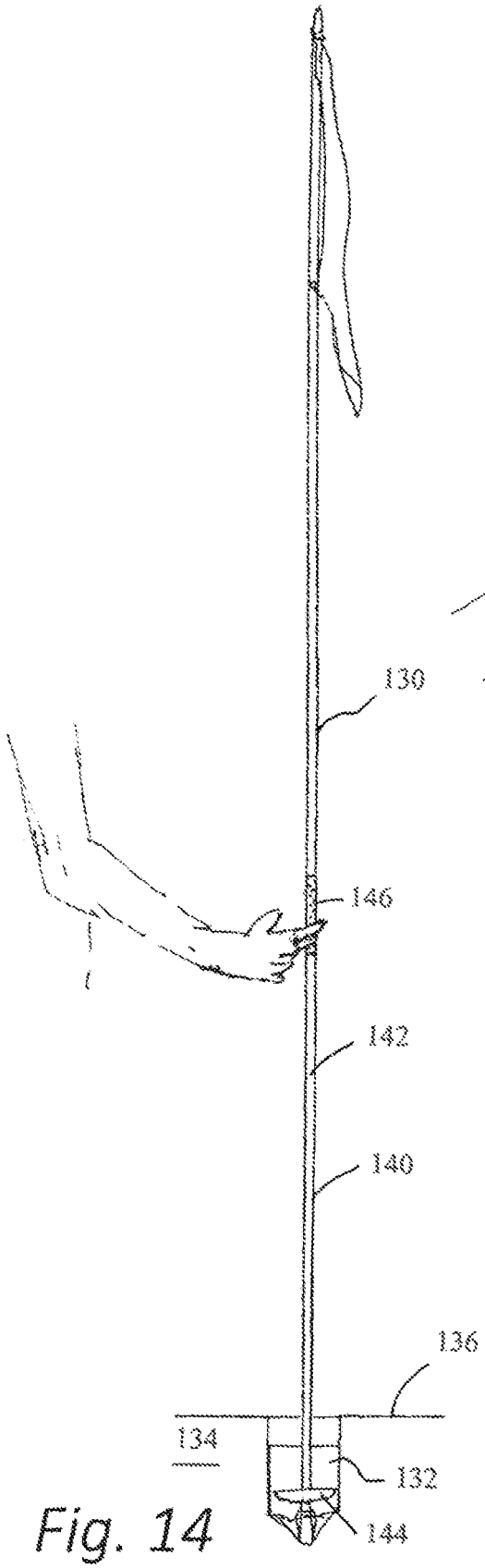
FIG. 14 is an elevation view of a flagstick in a cup with the ball lifting device seated at the bottom of a cup.
Figure 15:
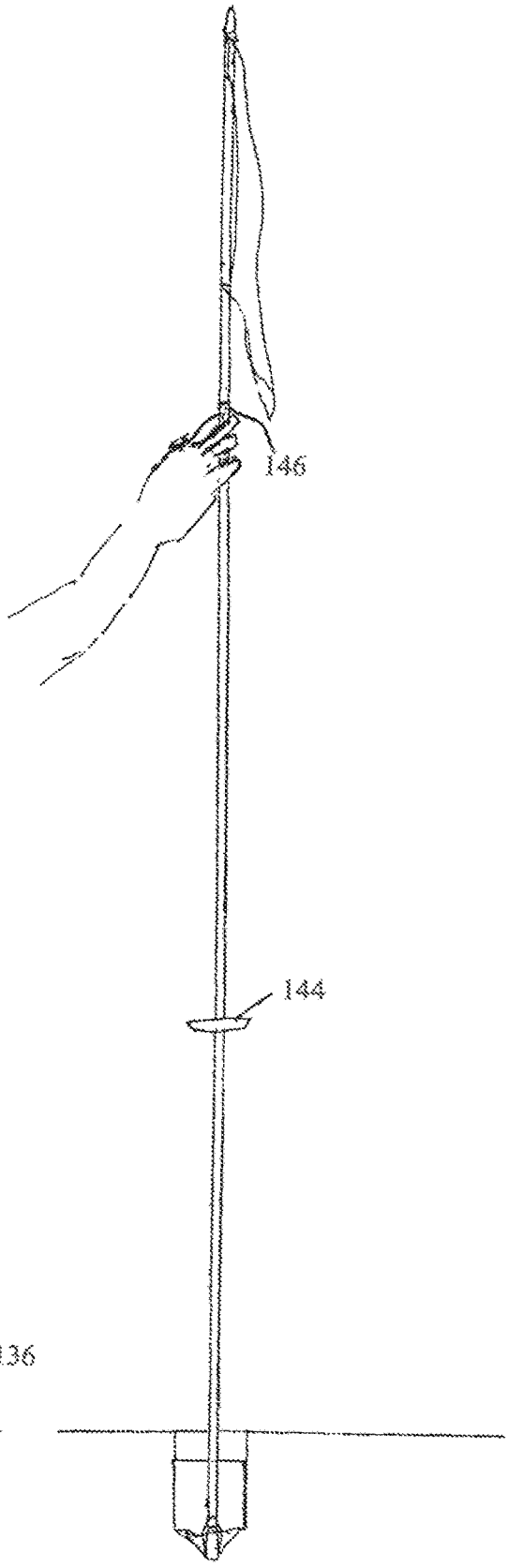
FIG. 15 is the view of FIG. 14 with the ball lifting device raised.
Figure 16:
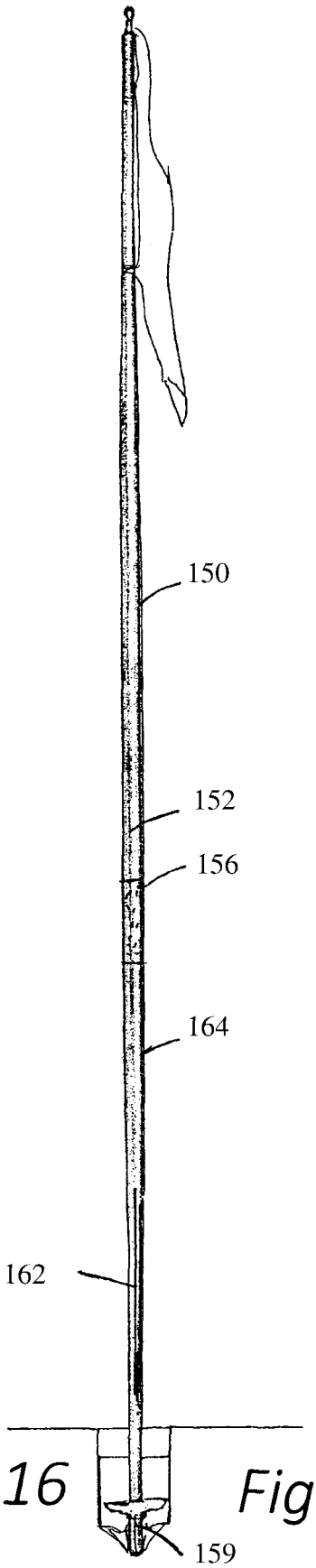
FIG. 16 is an elevational view of a flagstick in a cup, the flagstick being a tournament flagstick or a flagstick with tapers at the top and bottom and a thick middle section, the flagstick having a ball lifting device configured to accommodate the lower tapered portion and the thick middle section.
Figure 17:
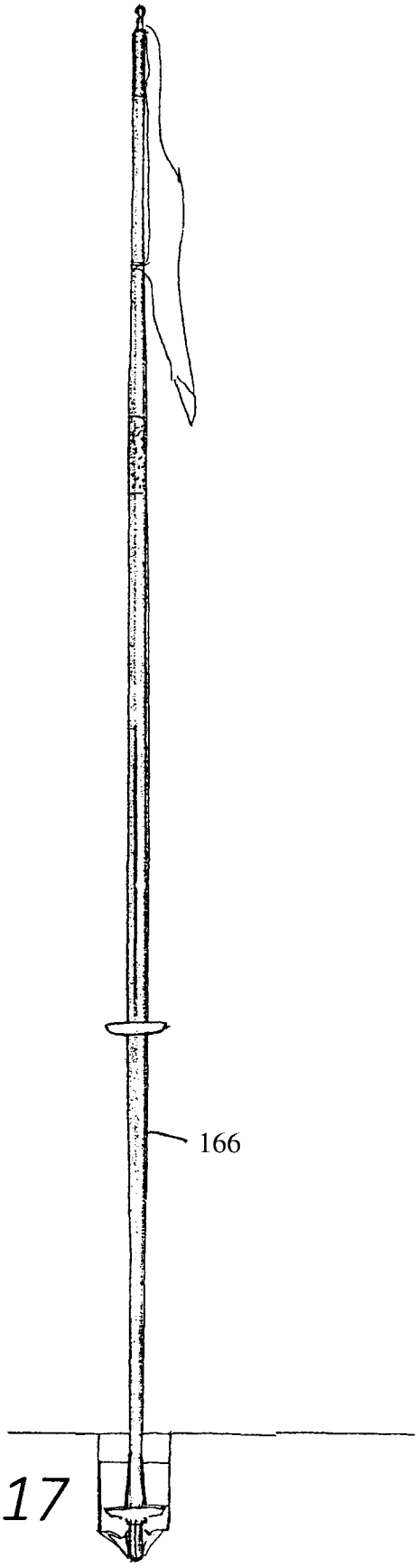
FIG. 17 is an elevational view of the flagstick of FIG. 16 with the ball lifting device raised.
Figure 18:
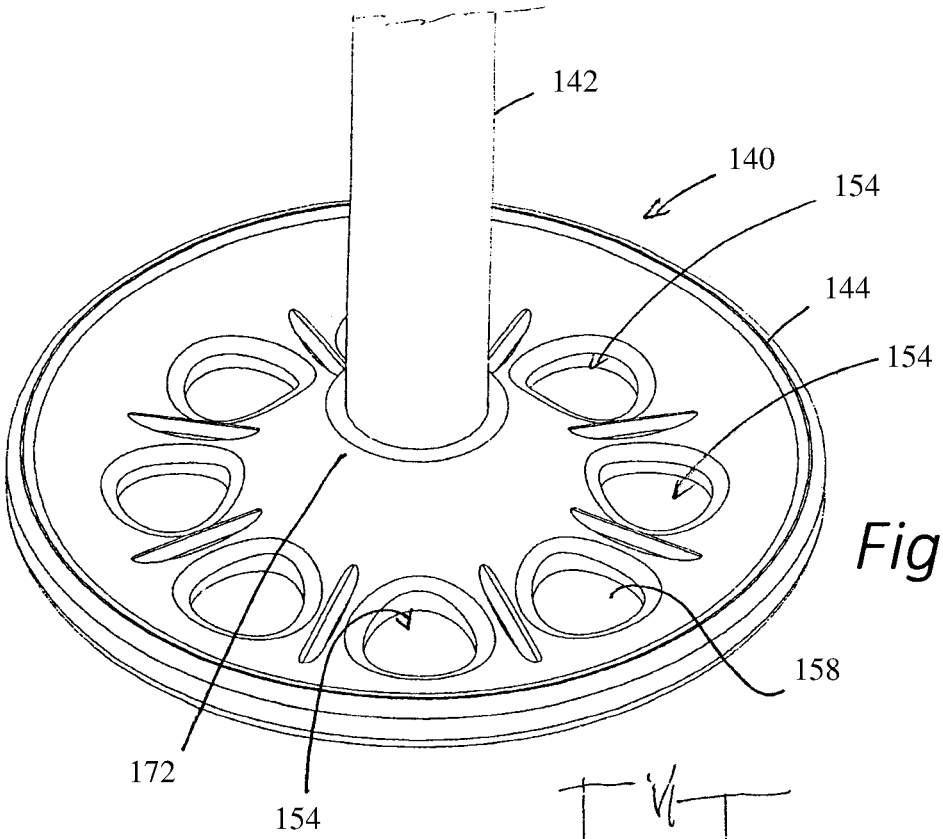
FIG. 18 is a downward looking perspective view of an embodiment showing a golf ball lifting device with the elevator having golf ball seats.
Figure 19:
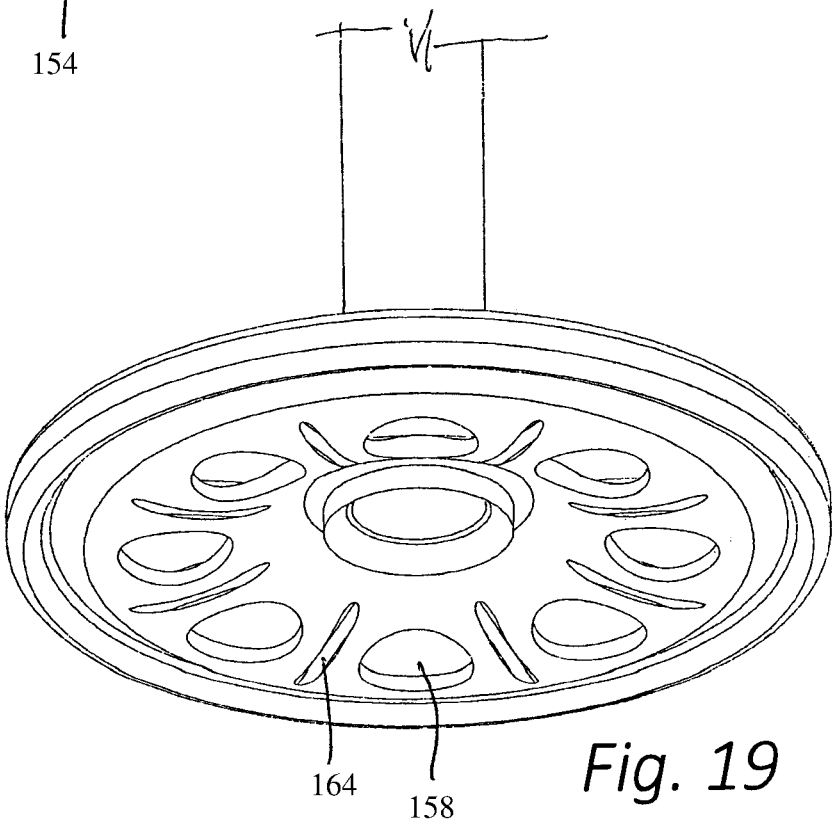
FIG. 19 is an upwardly looking perspective view of the golf ball lifting device of FIG. 18.
Figure 21:
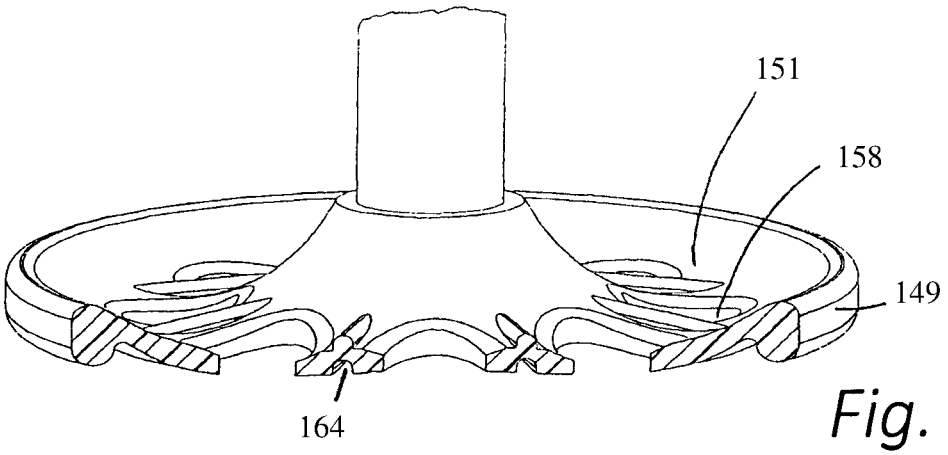
FIG. 21 is a cross sectional view of the golf ball lifting device of FIGS. 18-20 taken at line 21-21 of FIG. 20.
Figure 20:
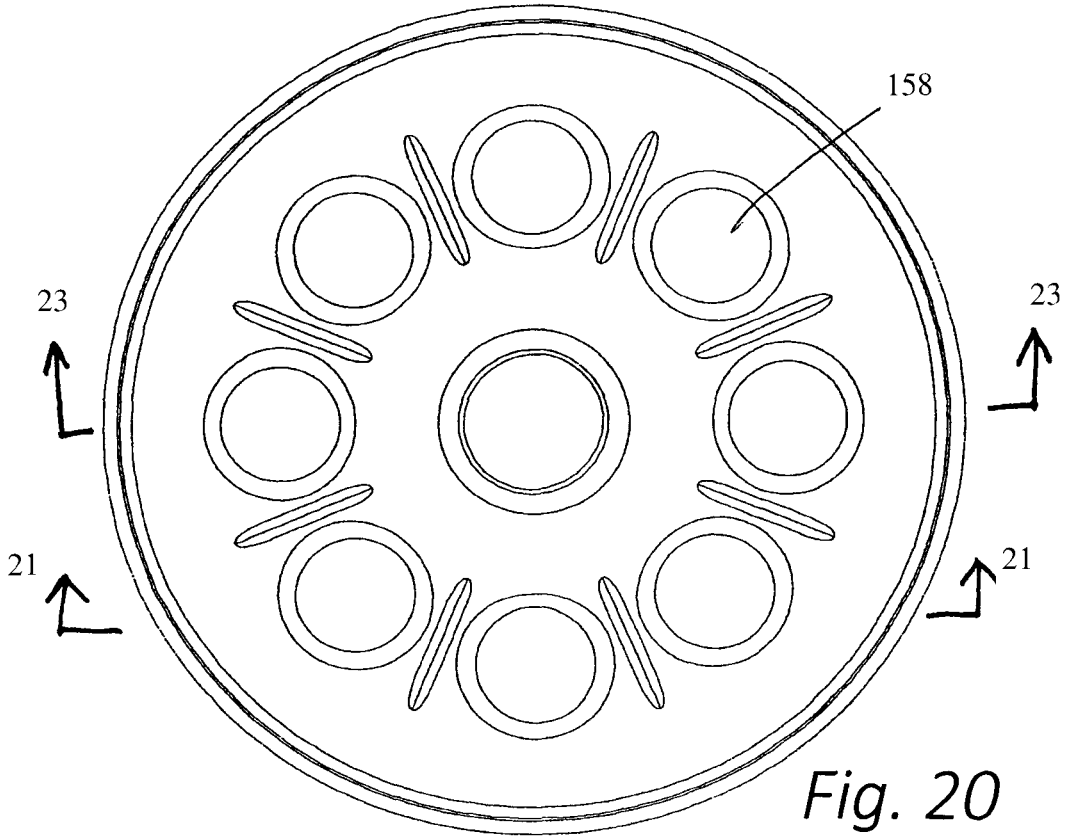
FIG. 20 is a top plan view of the golf ball lifting device of FIGS. 18 and 19.
Figure 22:
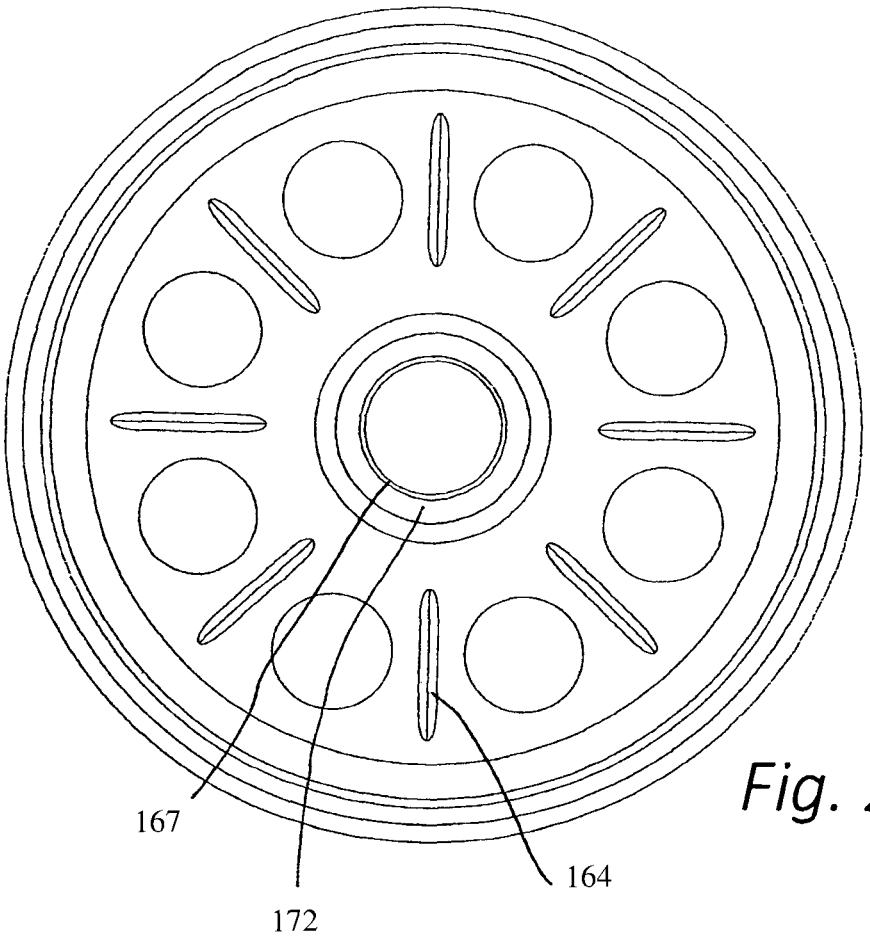
FIG. 22 is a bottom plan view of the golf ball lifting device of FIGS. 18-21.
Figure 23:
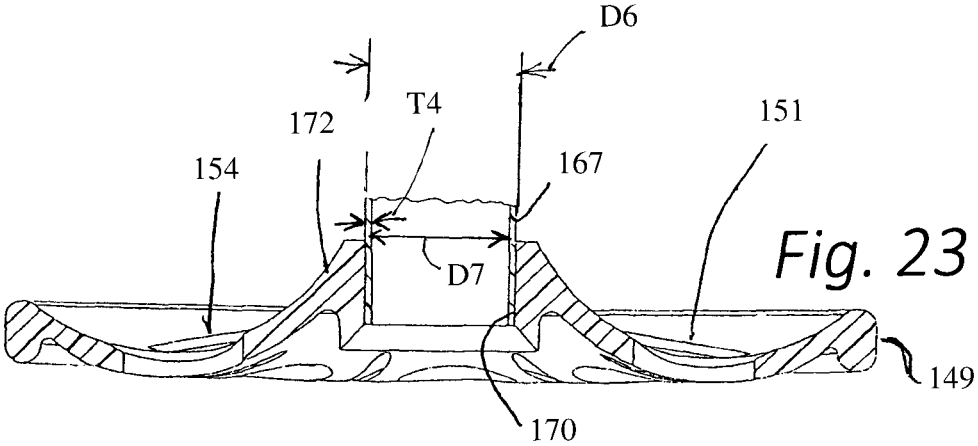
FIG. 23 is a cross sectional view of the golf ball lifting device of FIGS. 18-22 taken at line 23-23 of FIG. 20.
Figure 24:
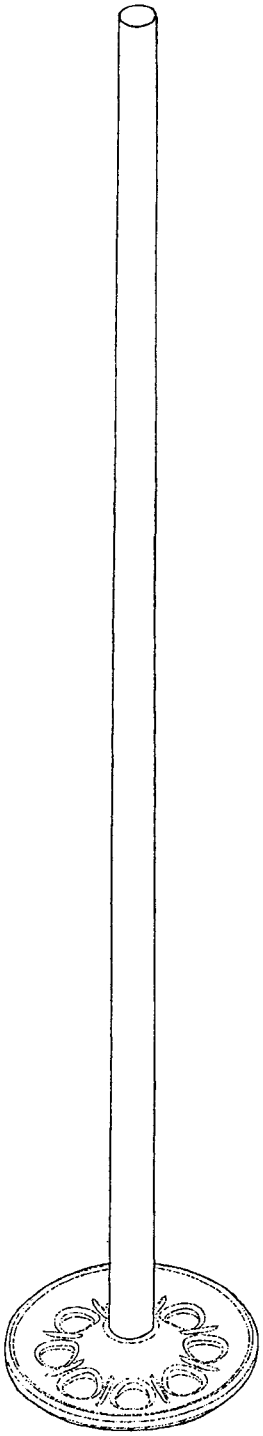
FIG. 24 is a perspective view of the golf ball lifting device of FIGS. 18-23.
Figure 25A:
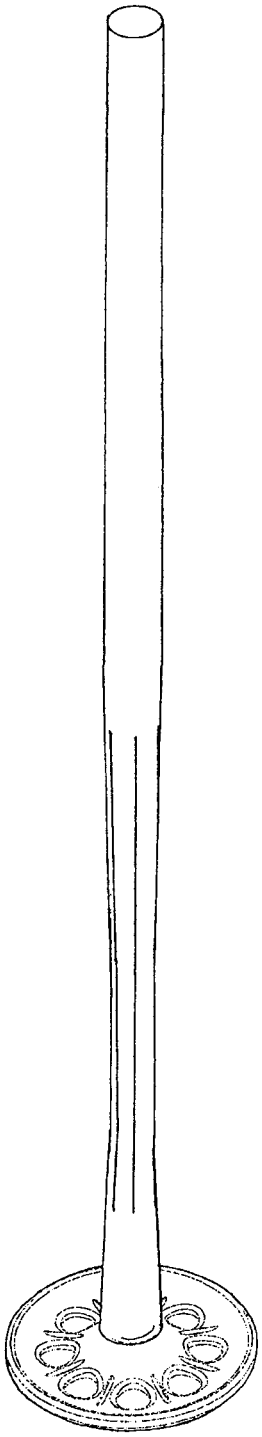
FIG. 25A is a perspective view of a golf ball lifting device such as shown in FIGS. 16 and 17.
Figure 26:
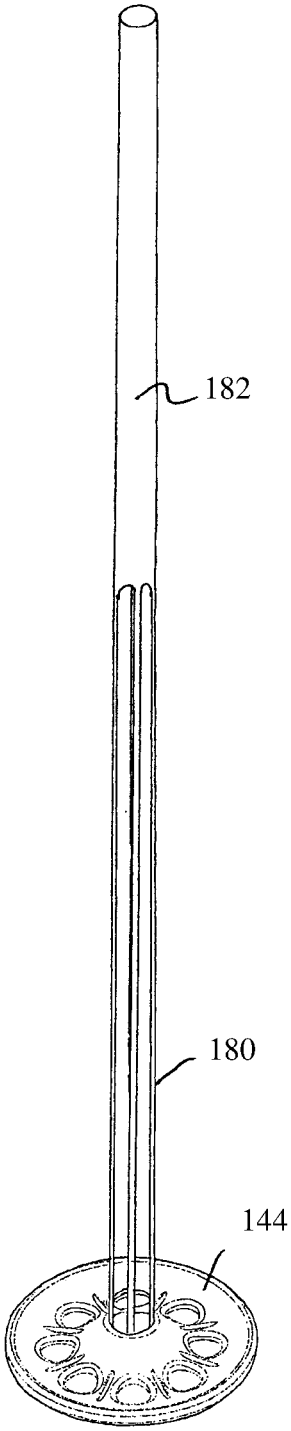
FIG. 26 is a perspective view of another embodiment of a golf ball lifting device.

Referring to FIGS. 18-23, detail of the elevator portion 144 of the lifting device 140 such as the lifting device of FIGS. 14-15 is depicted. An upper side has an annular concave region 151 with a plurality of golf ball seats 154 that are circumferentially spaced around the elevator. The seats 154 may be defined by the ribs 156 and/or the holes 158. The ribs 156 have corresponding recesses 164 on the bottom side 166 that aid in injection molding the elevator portions. The tubular handle 167 may be attached with an adhesive to the central bore 170 in the hub portion 172 of the elevator portion 144, for example with cyanoacrylate adhesives. In embodiments, the tubular handle may have an inside diameter of about 0.605 inches, plus or minus 0.06 inches. In embodiments, the wall thickness T4 of the tubular handle is 0.014 inches, plus or minus 0.04 inches. In embodiments the outside diameter D6 of the tubular handle is 0.633 inches, plus or minus 0.01 inches. In embodiments the outside diameter D6 of the tubular handle is 0.633 inches, plus or minus 0.1 inches. In embodiments the outside diameter D6 of the tubular handle is less than 0.15 inches greater than the outside diameter of the flagstick. In embodiments the outside diameter of the tubular handle is less than 0.12 inches greater than the outside diameter of the flagstick. In embodiments the outside diameter of the tubular handle is less than 0.20 inches greater than the outside diameter of the flagstick. In embodiments the outside diameter of the tubular handle is less than 0.24 inches greater than the outside diameter of the flagstick. In embodiments the inside diameter D7 of the tubular handle is 0.605 inches, plus or minus 0.03 inches. In embodiments the inside diameter D7 of the tubular handle is 0.55 inches, plus or minus 0.1 inches.

Referring to FIGS. 24 to 29, various configurations of lifting devices are illustrated. The embodiments of FIGS. 24 and 25 have been described above. The embodiment of FIG. 26 has one or more thin strips 180 extending from the elevator portion 144 to the upper handle portion 182. This allows visibility of the flagstick. The strips are thin enough that the effect of the strips on a golf ball impacting the flagstick when in the cup is considered to be minimal.

Figure 27:
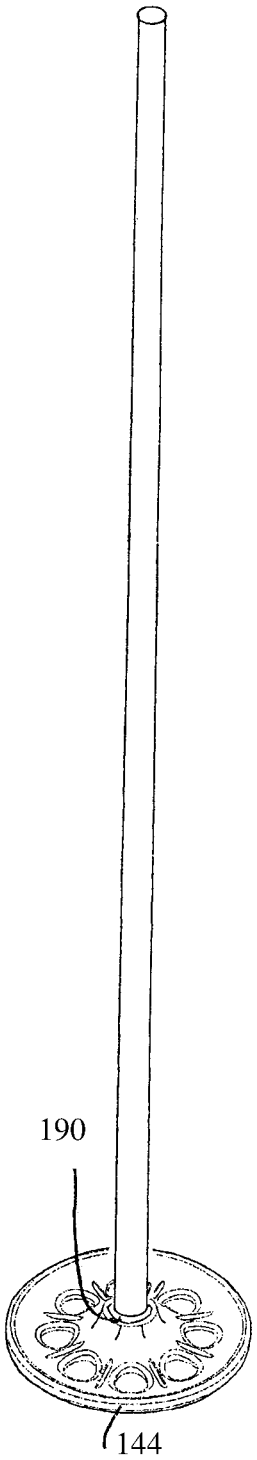
FIG. 27 is a perspective view of a golf ball lifting device sized for a ⅜ inch flagstick using the elevator of other embodiments.
Figure 25B:
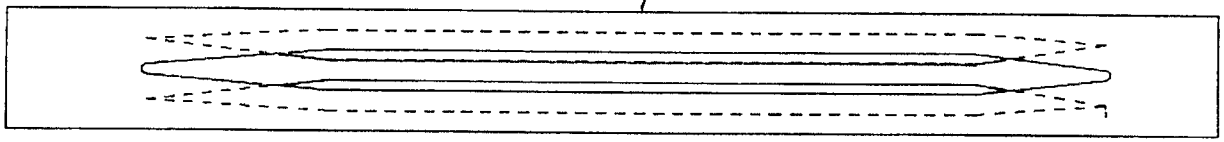
FIG. 25B is a side elevation view of a preform tubing for another embodiment of a tubular handle for a golf ball lifting device for tournament flagsticks.
Figure 25C:
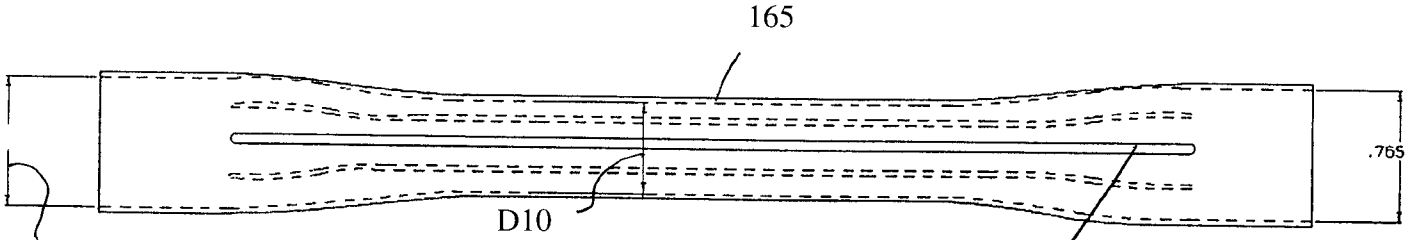
FIG. 25C is a side elevation view of tubular handle for a golf ball lifting device for tournament flagsticks formed from the preform of FIG. 25B.
Figure 25D:
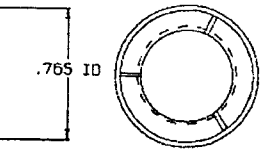
FIG. 25D is an end view of the tubular handle of FIG. 25C.

Referring to FIG. 27, a tubular handle sized for 0.375 inch flagstick has a wall thickness of 0.010 to 0.025 and a gap between the flagstick and tubular handle of a few thousands to 0.020 thousandths. A bushing 190 may be attached to the reduced size tubular handle to allow the elevator portion 144 of previously described embodiments, for example as shown in FIGS. 18-22. The bushing may be attached with adhesives or threads.

Figure 28:
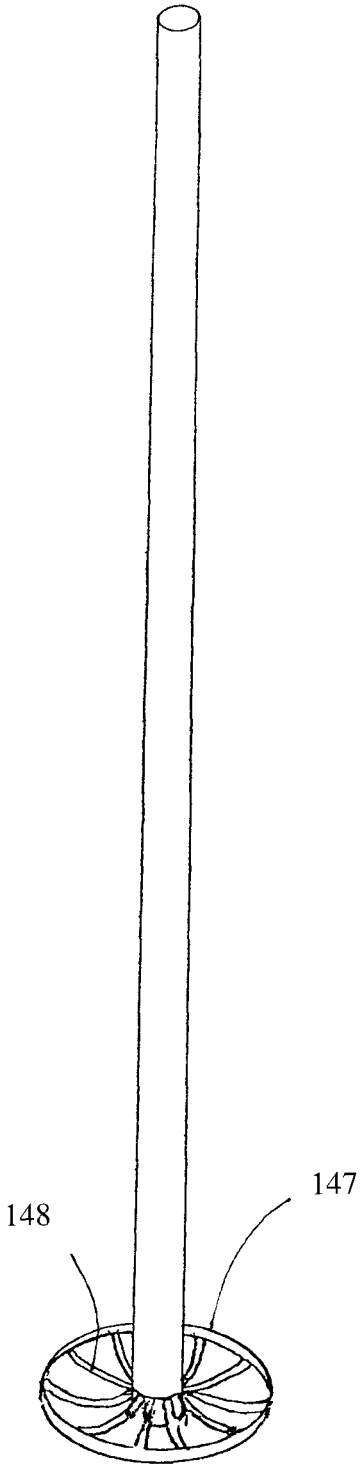
FIG. 28 is a perspective view of a golf ball lifting device with an elevator being configured as a basket.
Figure 29:
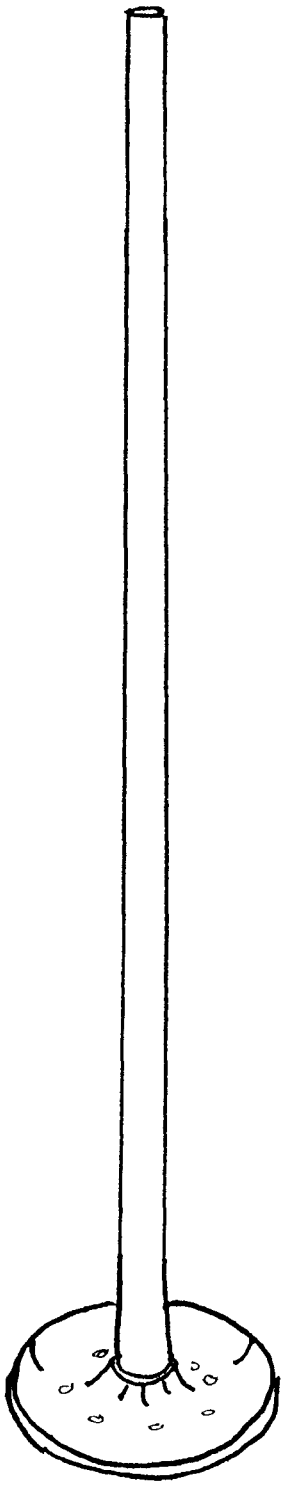
FIG. 29 is a perspective view of a golf ball lifting device with a bowl shaped elevator.
Figures 30A, 30B:
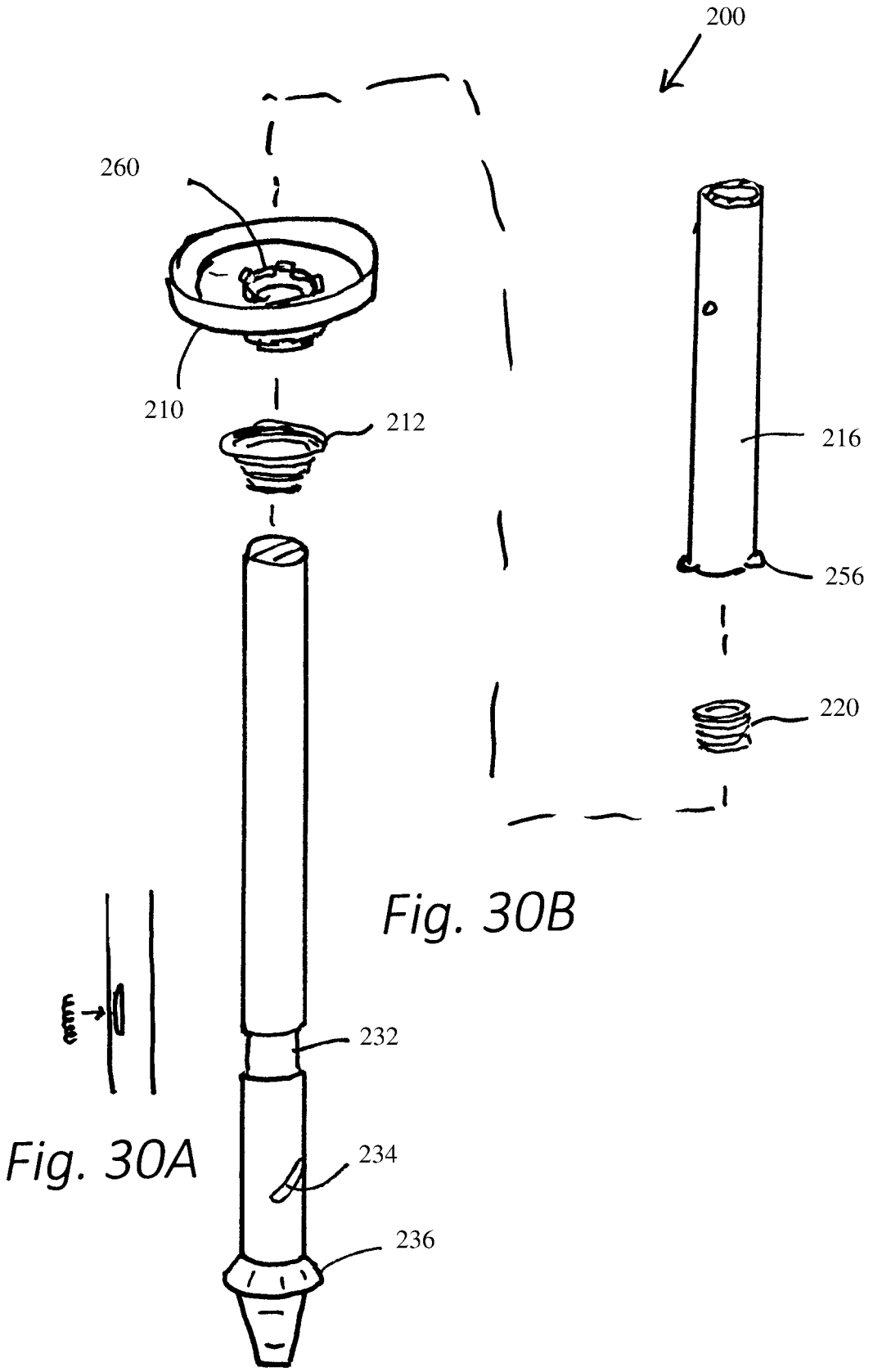
FIG. 30A is a perspective view of a portion of the flagstick of FIG. 30B
FIG. 30B is an exploded view of a flagstick with a golf ball ejector.

Referring to FIG. 28, an elevator portion 147 formed of thin polymer members 148 providing a limited collapsibility or deflection when laid on the green surface can minimize green damage. Such an elevator may be attached to a tubular handle slidable on the flagstick or directly to the flagstick without a tubular handle. The majority of the area defined by the periphery of the elevator is open. FIG. 29 illustrates another embodiment with a bowl shape and apertures for water drainage.

Referring to FIG. 30A-35, a flagstick with a manually operated golfball ejector 200 is illustrated. In an embodiment, the ejector comprises an elevator 210, a elevator spring 212 for manually loading the elevator, a handle 216 for pushing the elevator downwardly and loading the elevator spring, a elevator release mechanism 218 and handle spring 220 for returning the spring to a normal ready-to-use position. A flagstick pole 200 has a circumferential recess 232 for receiving the handle spring, a helical cam groove 234 for providing some rotation to the elevator, and a conventional ferrule 236 that can seat the elevator spring.

Figure 31:
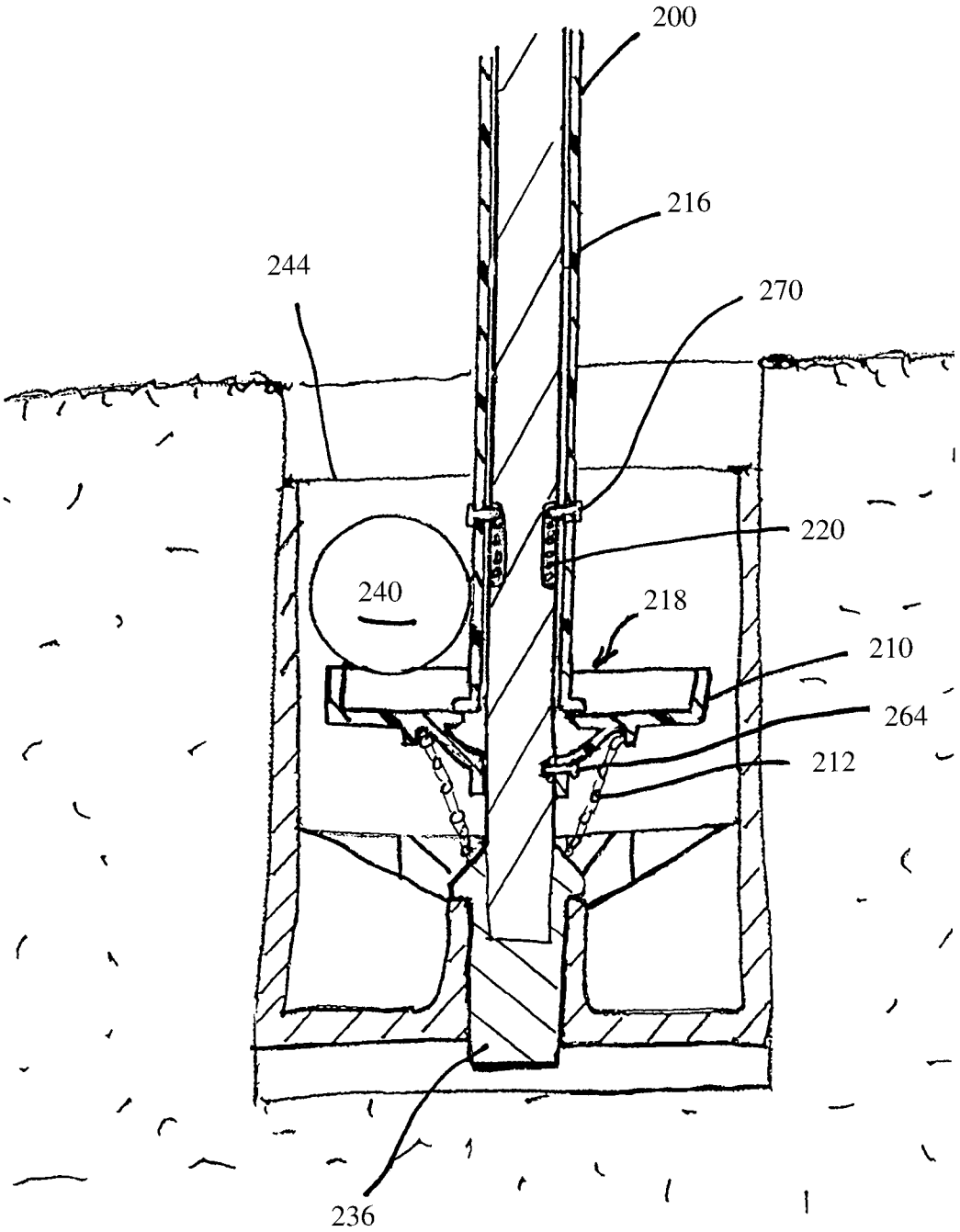
FIG. 31 is a cross sectional view of a flagstick in a cup with a golf ball.
Figure 32:
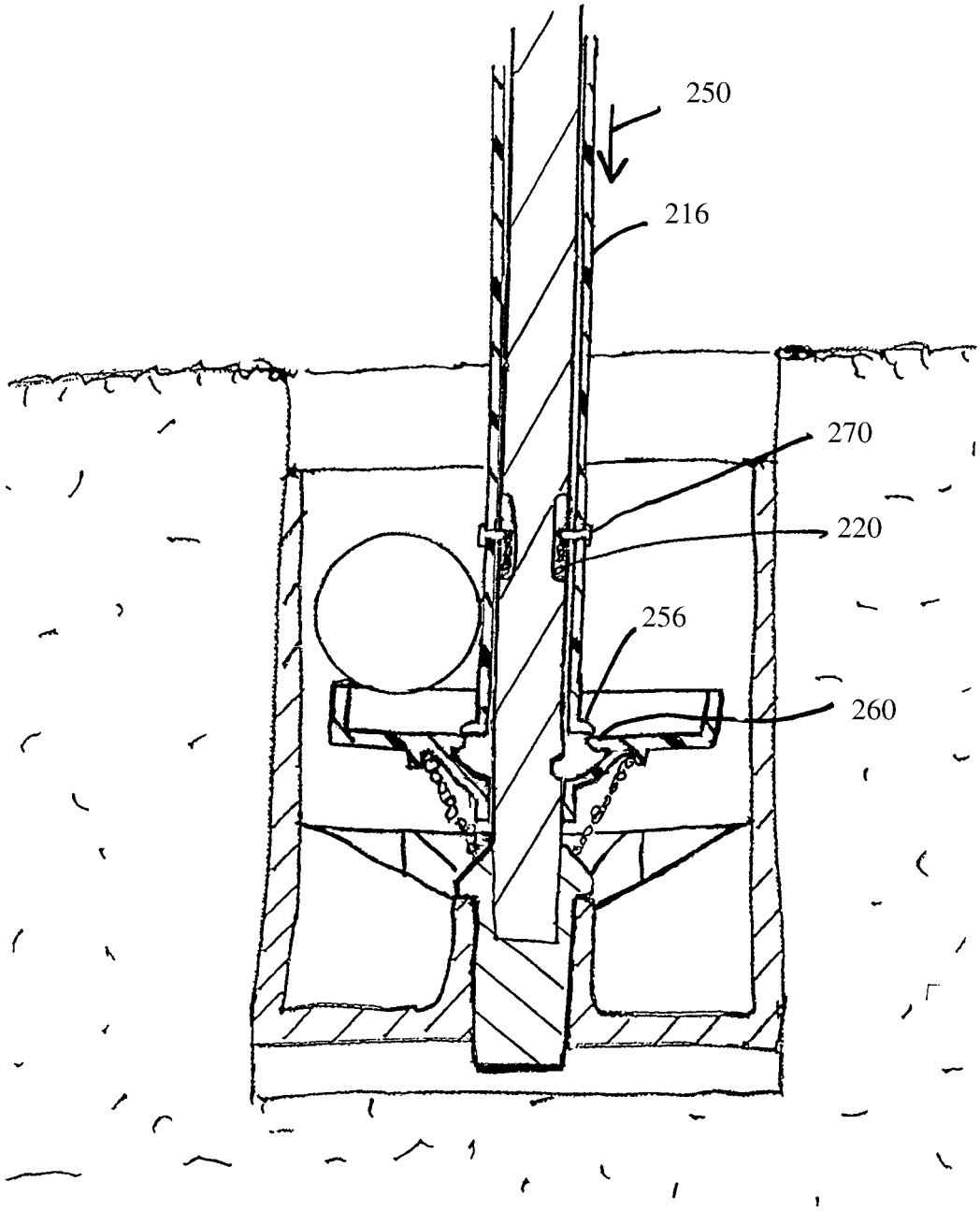
FIG. 32 is a cross sectional view of the flagstick and cup of FIG. 31 with the elevator partially depressed.

Referring to FIG. 31, a golf ball 240 is located in a cup 244 and the handle 216 and elevator are in a normal position. In FIG. 32, a golfer has grasped the tubular handle and is pushing downward thereon as indicated by the arrow 250. Tabs 256 on the handle engage lugs 260 on the elevator to allow the handle to push the elevator downward. The lugs being in an obstruction position. The elevator has a follower 264 that is seated in cam groove 234 to provide some rotation of the elevator as it is pushed downwardly. In FIG. 32 the cam follower may be a threaded screw, is not shown as it has slightly rotated out of the cross sectional view of FIG. 31. The handle spring 220 is partially compressed in FIG. 31 by way of a spring engagement portion 270 which may be a rivet, screw or other projection from the handle. The lugs of the elevator are close to moving out of an obstructing position.

Figure 33:
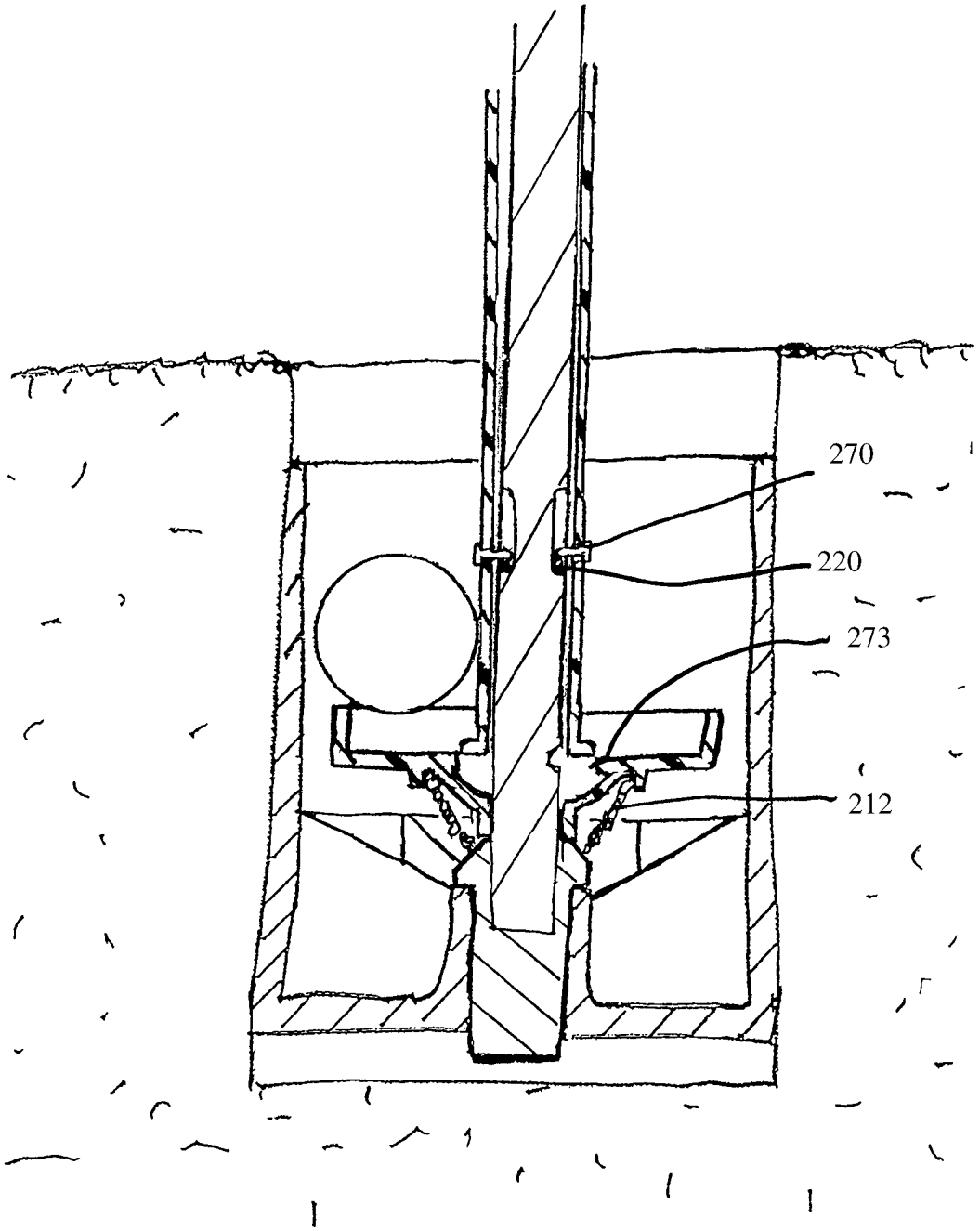
FIG. 33 is a cross sectional view of the flagstick and cup of FIG. 31 with the release mechanism actuated.
Figure 34:
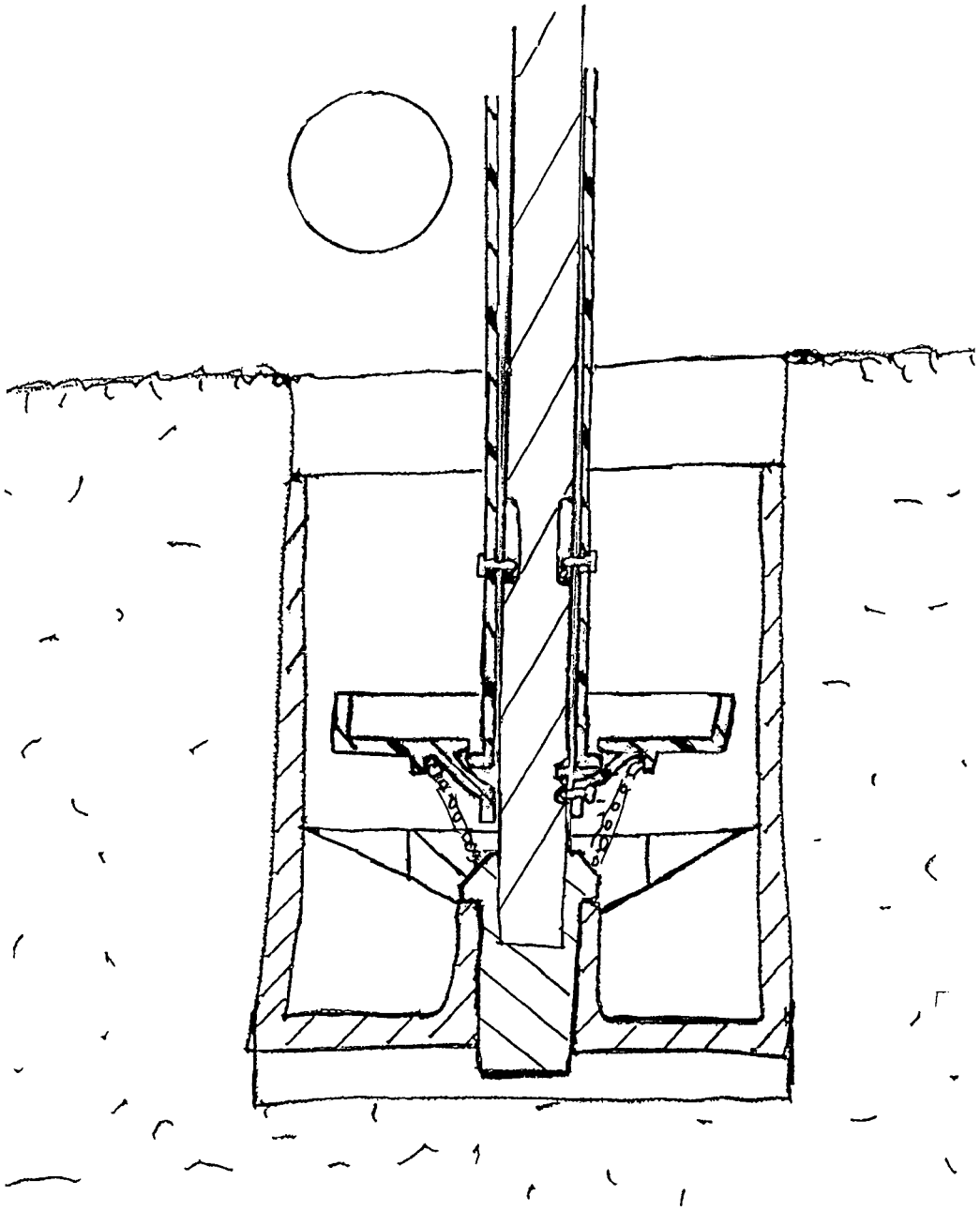
FIG. 34 is a cross sectional view of the flagstick and cup of FIG. 31 ejecting the golf ball.
Figure 35:
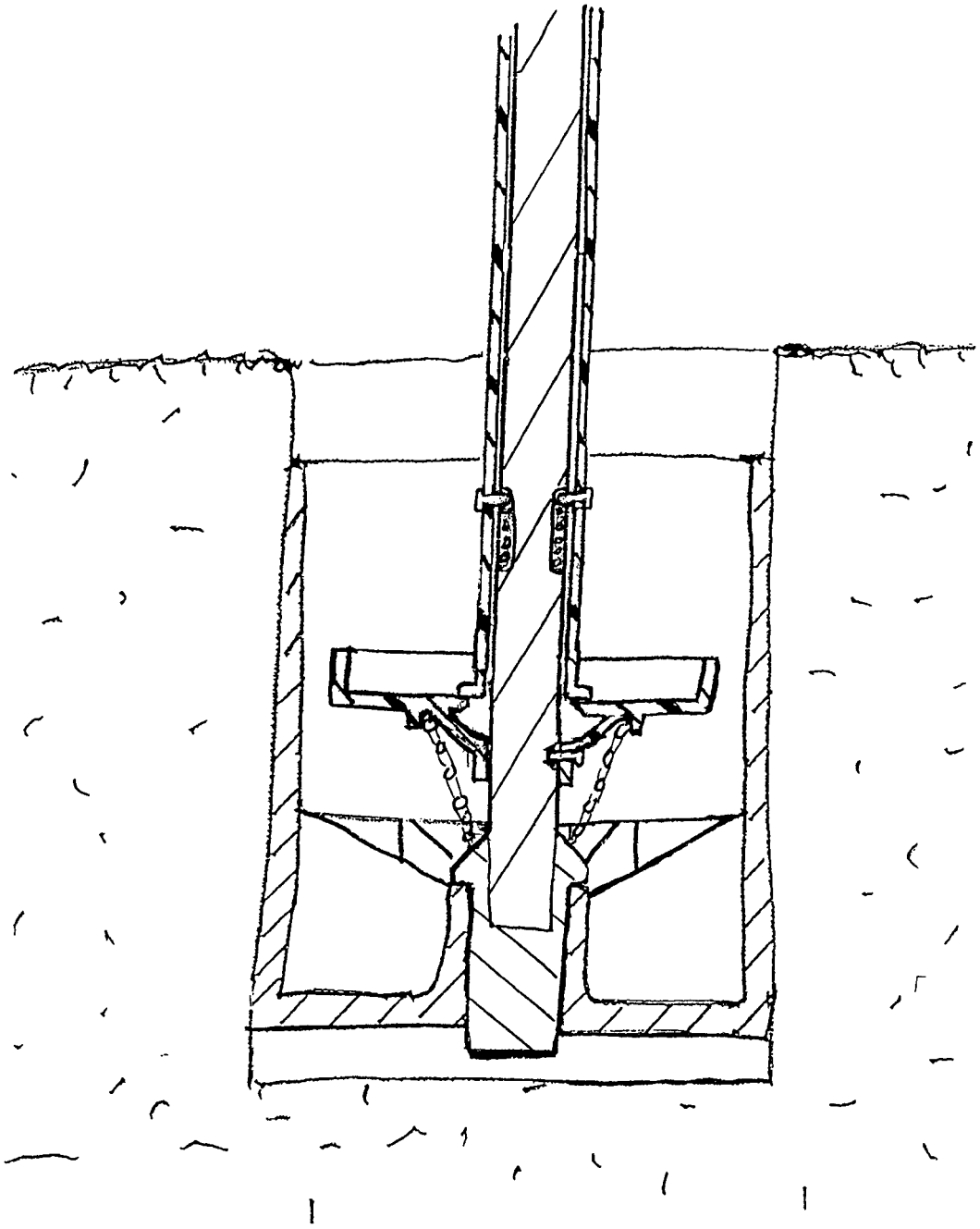
FIG. 35 is a cross sectional view of the flagstick and cup of FIG. 31 with the handle and elevator returned to a normal position.

Referring to FIG. 33, the rotation of the elevator by the cam follower in the cam groove has just moved the lugs out of an obstructing position such that recesses 273 adjacent to the lugs are in axial alignment with the tabs and the elevator spring 212 is in a fully compressed state. This allows an abrupt release of the compressed elevator spring such that the golf ball is ejected from the cup as shown in FIG. 34. In FIG. 35, the golfer has released the handle and it returns to its normal position as also shown in FIG. 31. Cam surfaces on the tabs and lugs can facilitate the return of the handle to the normal position. In embodiments, see FIG. 30*a*, the flagstick may have a groove for the handle spring, with a spring therein, and the spring engagement member may be a cam follower. The groove may also have a helical orientation for facilitating the tab lug interaction.

Figure 36:
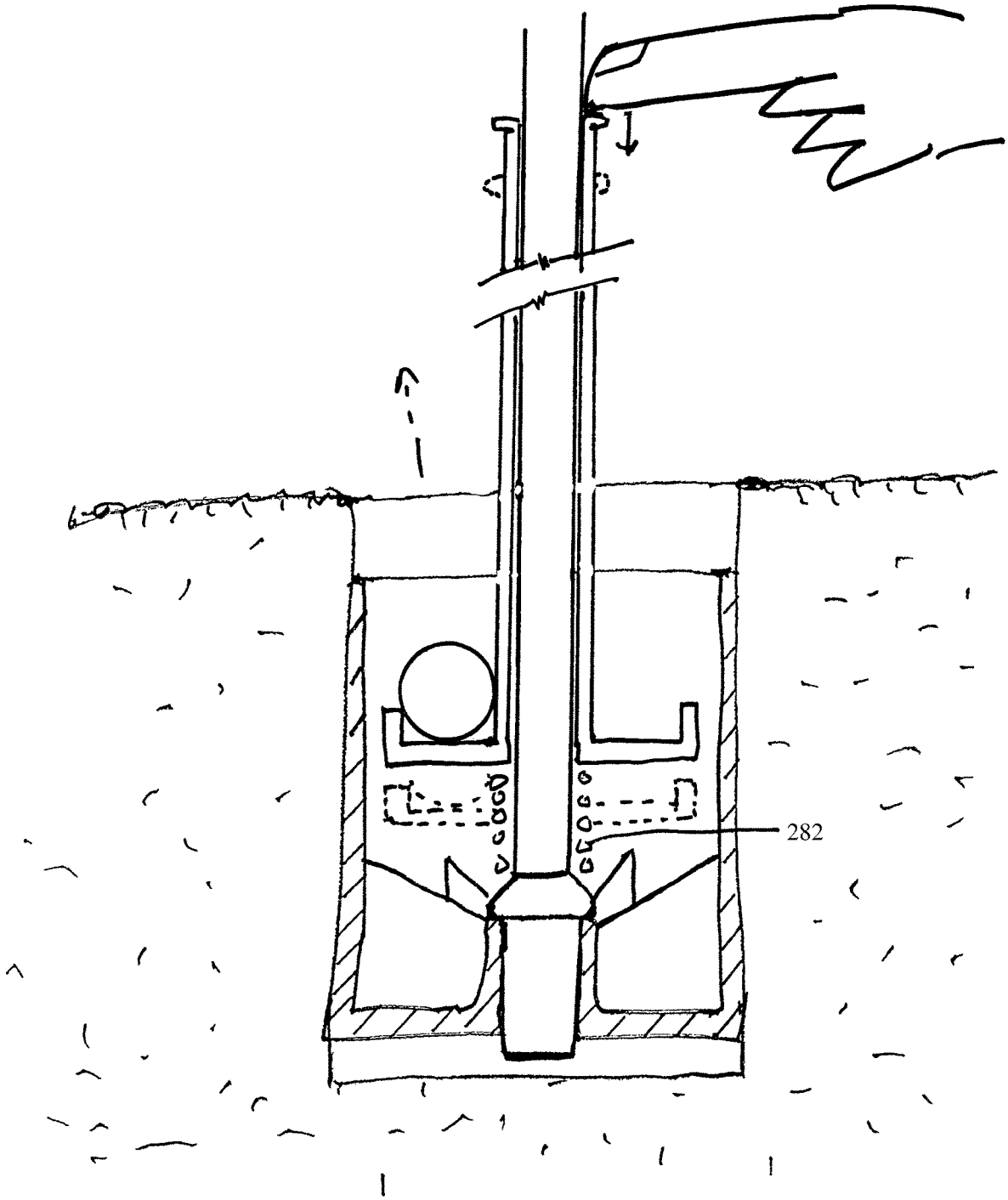
FIG. 36 is a cross sectional view of a spring loaded elevator that is manually depressed and released.

Referring to FIG. 36, in an embodiment, the golfer may load the elevator spring 282 manually with his finger to the loaded position shown by dashed lines and release the spring by simply allowing his finger to slip off of the handle allowing the ball to pop up out of the cup.

Figure 37:
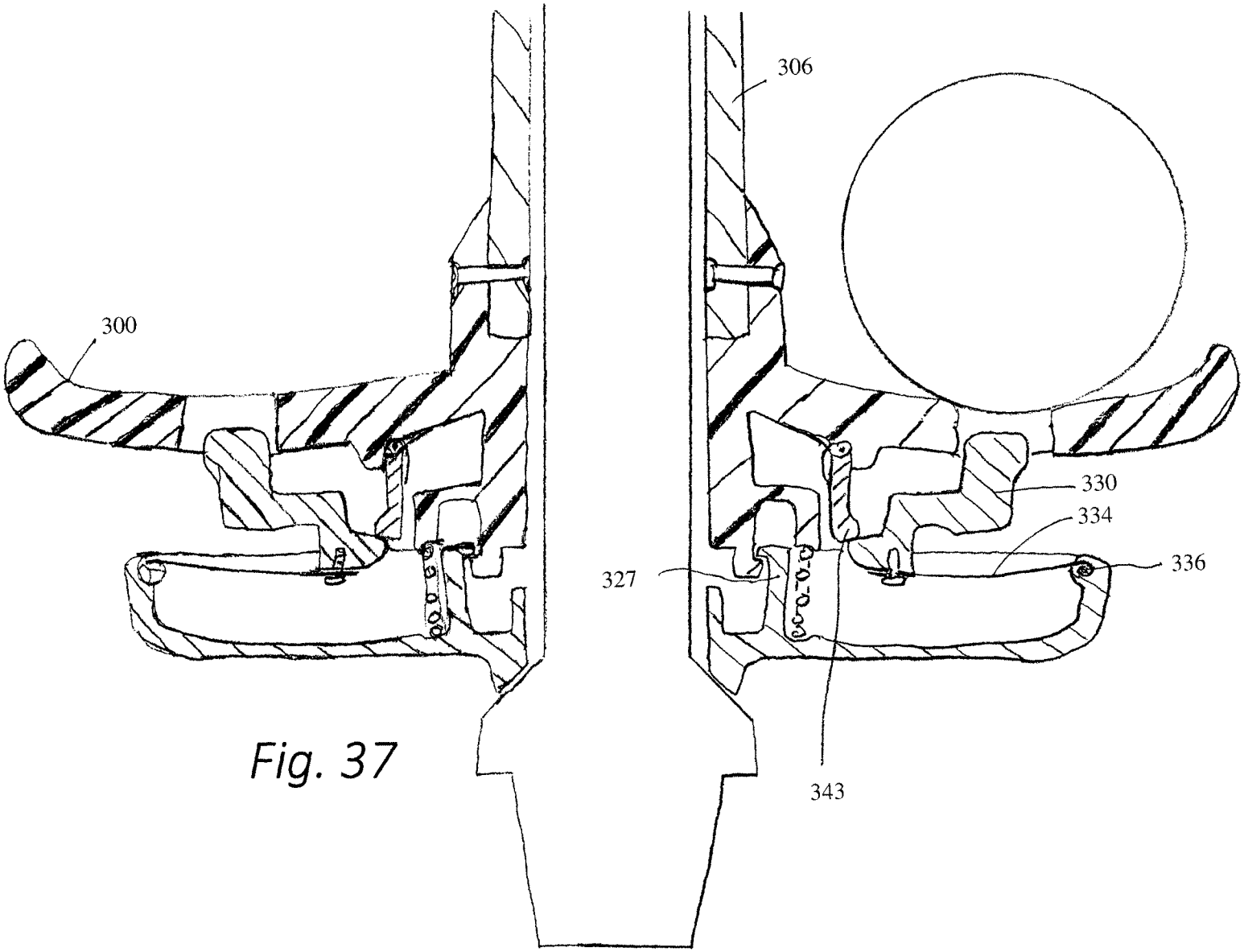
FIG. 37 is a cross sectional view of a lifting device with an elevator with a handle actuated golf ball ejection mechanism.
Figure 38:
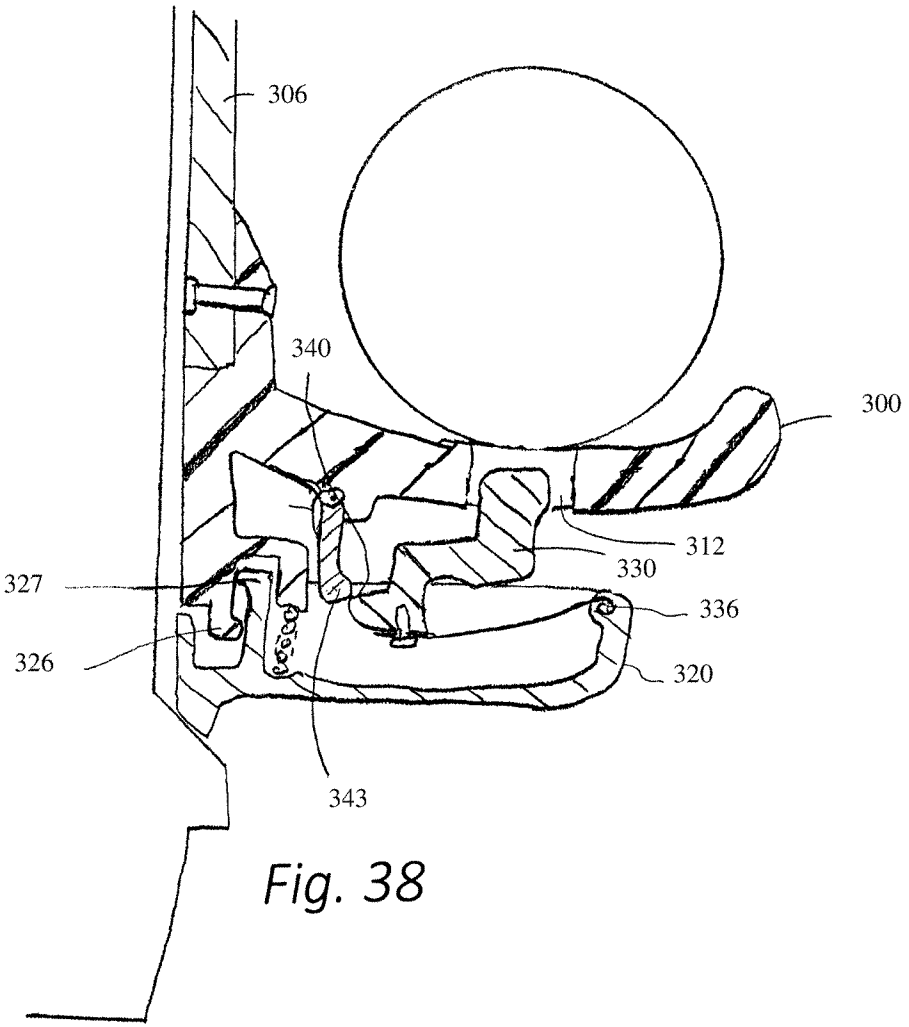
FIG. 38 is the lifting device of FIG. 37 wherein the downward pushing of the handle portion charges an ejection spring.
Figure 39:
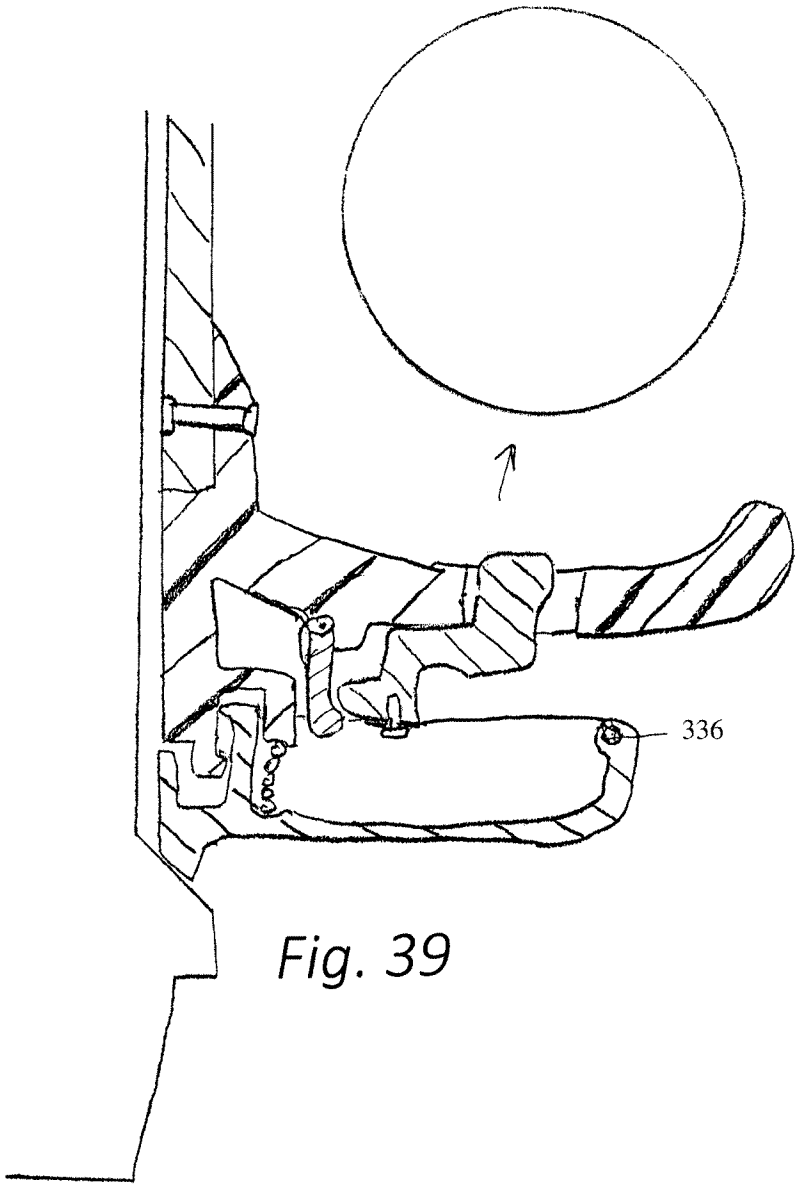
FIG. 39 is the lifting device of FIGS. 37 and 38 with the ejection spring released.

Referring to FIGS. 37-39, another embodiment is illustrated wherein the golfer can either lift the ball out manually by raising the handle or can eject the ball by pushing down on the handle. Additionally the unit is a single mechanism that does not require flagstick modification.

The elevator 300 is fixed to the tubular handle 306 by adhesives, fasteners, press fit, threads or the like. The elevator has several golfball receiving regions defined by apertures 312 in the elevator. The lower base 320 is positioned below the elevator and is vertically movable therewith a restricted distance as controlled by suitable cooperating stops 326, 327. When the tubular handle is pushed downward, the striker 330 connected to the lower base 320 by leaf spring 334, is pushed downwardly loading the leaf spring and striker as shown in FIG. 38. The striker pivots about pin 336 and thereby moves slightly radially outward with respect to the pin so that the cam surface 340 disengages with the pivoting catch member 343 releasing the striker which then impacts and launches the golfball as depicted in FIG. 39. The catch member is also restricted in motion and is spring loaded to be biased toward the catch positon. When the handle is released by the golfer, the handle raises along with the elevator with respect to the flagstick and the base. The catch pivots out of an obstructing position to reengage the striker and the device is reset in the configuration of FIG. 37.

A suitable device will have a plurality of apertures in the elevator and a corresponding number of striker mechanism.

Figure 40:
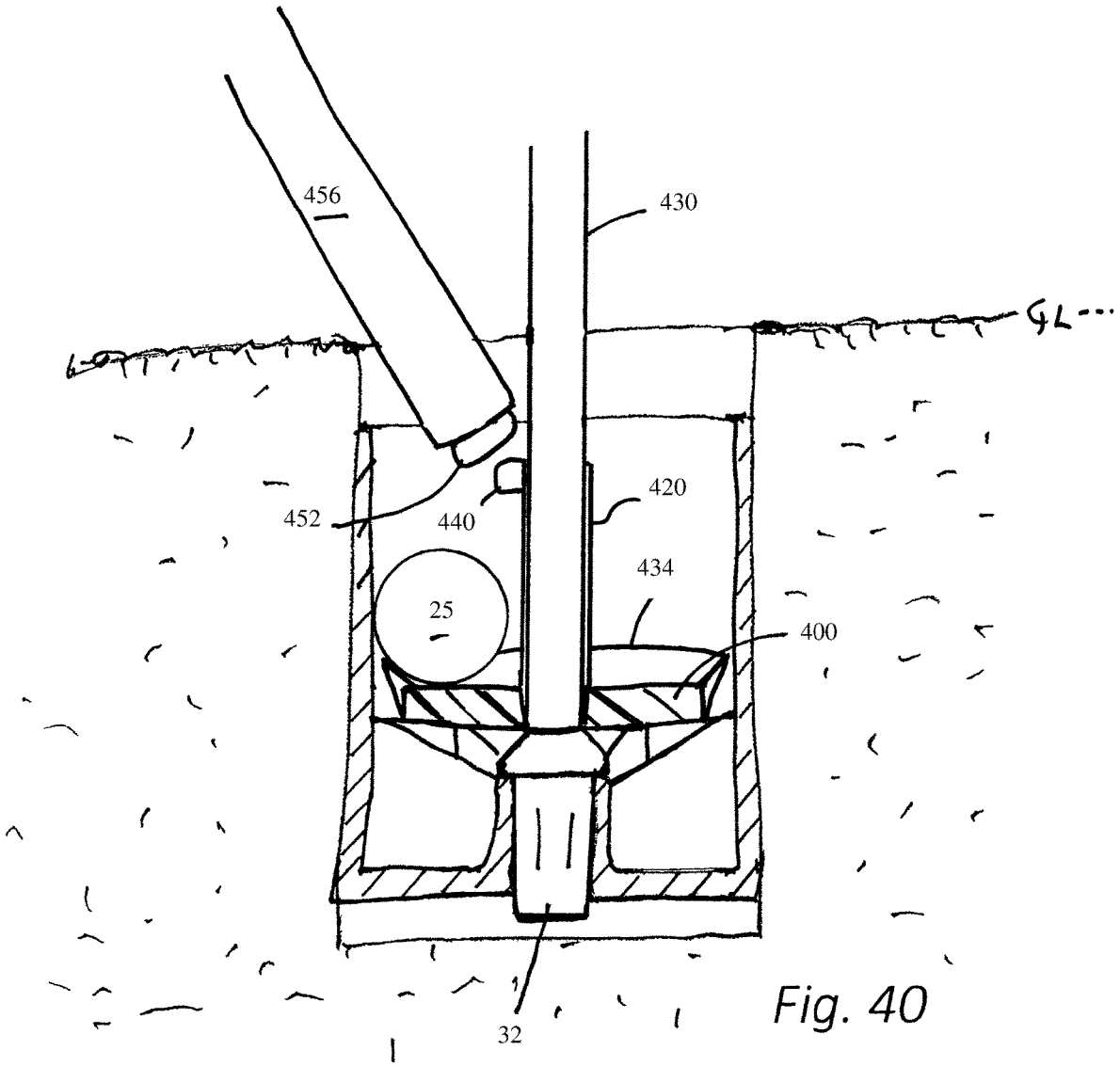
FIG. 40 is an elevation view of a flagstick in a cup with the ball lifting device seated at the bottom of a cup.
Figure 41:
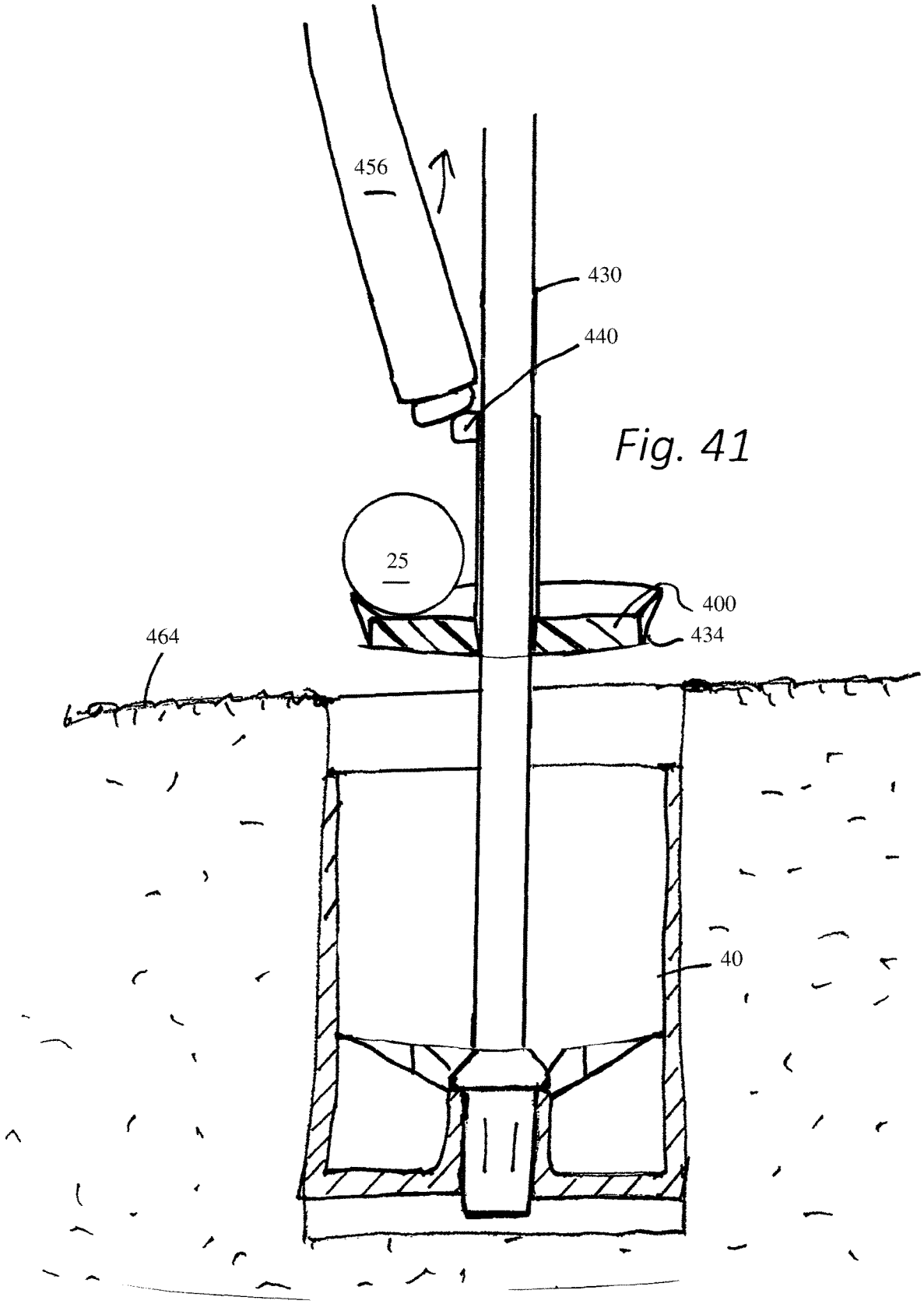
FIG. 41 is the view of FIG. 40 with the ball lifting device raised.
Figure 42:
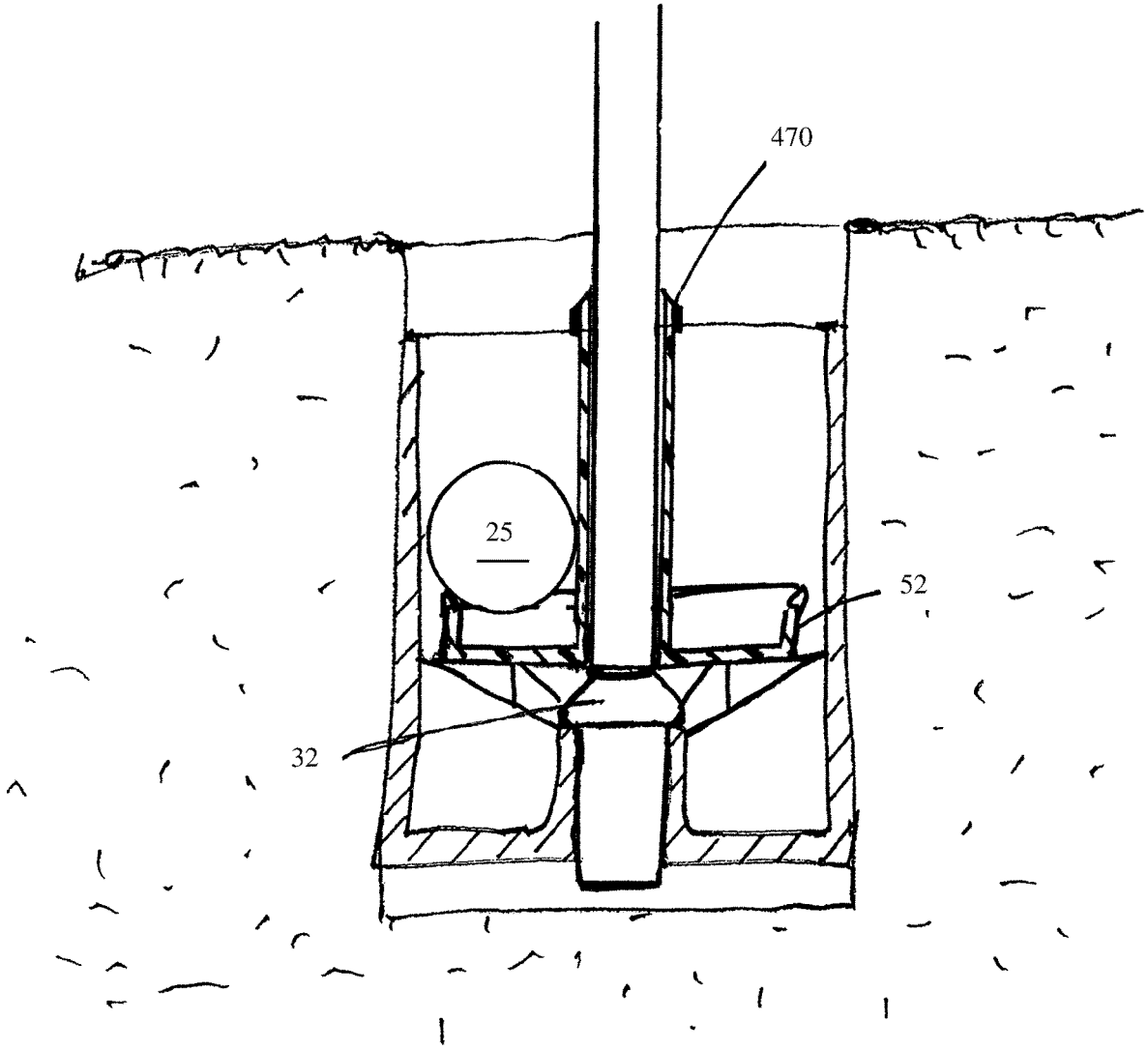
FIG. 42 is another embodiment with magnet or ferrous material at an upper margin of the lifting device below the lip of the hole.

Referring to FIGS. 40 and 41, another embodiment is illustrated where the lifting device 400 in the unelevated position is entirely below the green level GL. A tube 420 or partial tube or strip of material or other axially extending member extending along the flagstick 430 is secured to the elevator 434. A catch means 440 such as a magnet or hook or loop is positioned below the green level and attached to the tube 420 and therefor will not in any way impact the golf ball during putting or play. A magnet 452 or hook on the tip of the putter 456 or other tool may be used to temporarily attach to the lifting device 400 for raising the device with the ball 25 on the elevator 434, see FIG. 40. In embodiments the lifting device can be raised several feet off the floor for grasping the golfball without the golfer leaning over. In embodiments the elevator can allow the golfball to roll off the elevator as it is raised above the green level out of the cup to be picked up from the green surface 464. FIG. 42 is an embodiment with a magnetic band 470 attached to the top of the tubular portion of the lifting device for connection to a magnet on a putter or other tool.

Figure 43A:
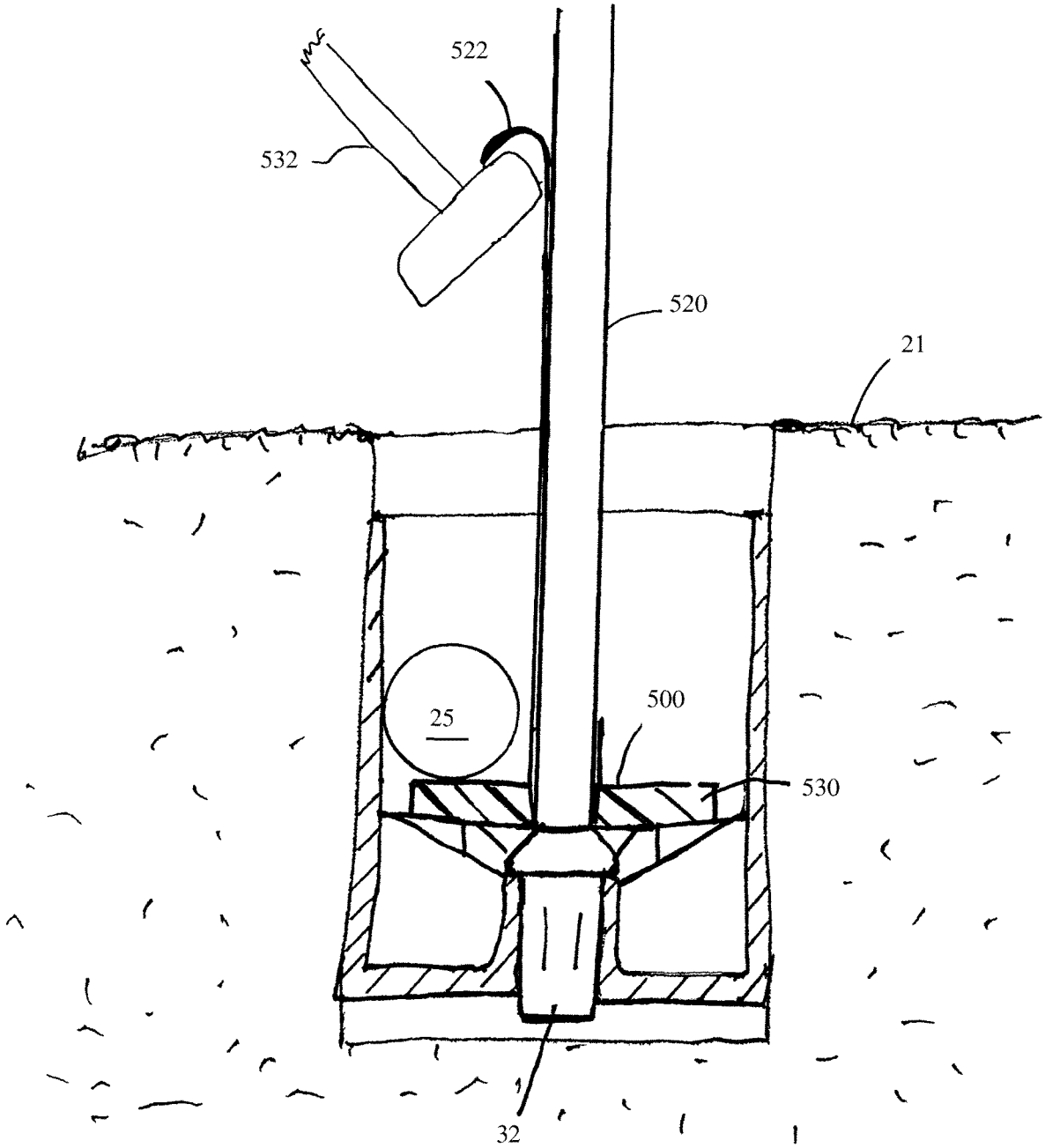
FIG. 43A is an elevation of another embodiment of a lifting device with the handle comprising a thin member extending upwardly along the flagstick with a hook for grabbing manually or with a golf club.
Figure 43B:
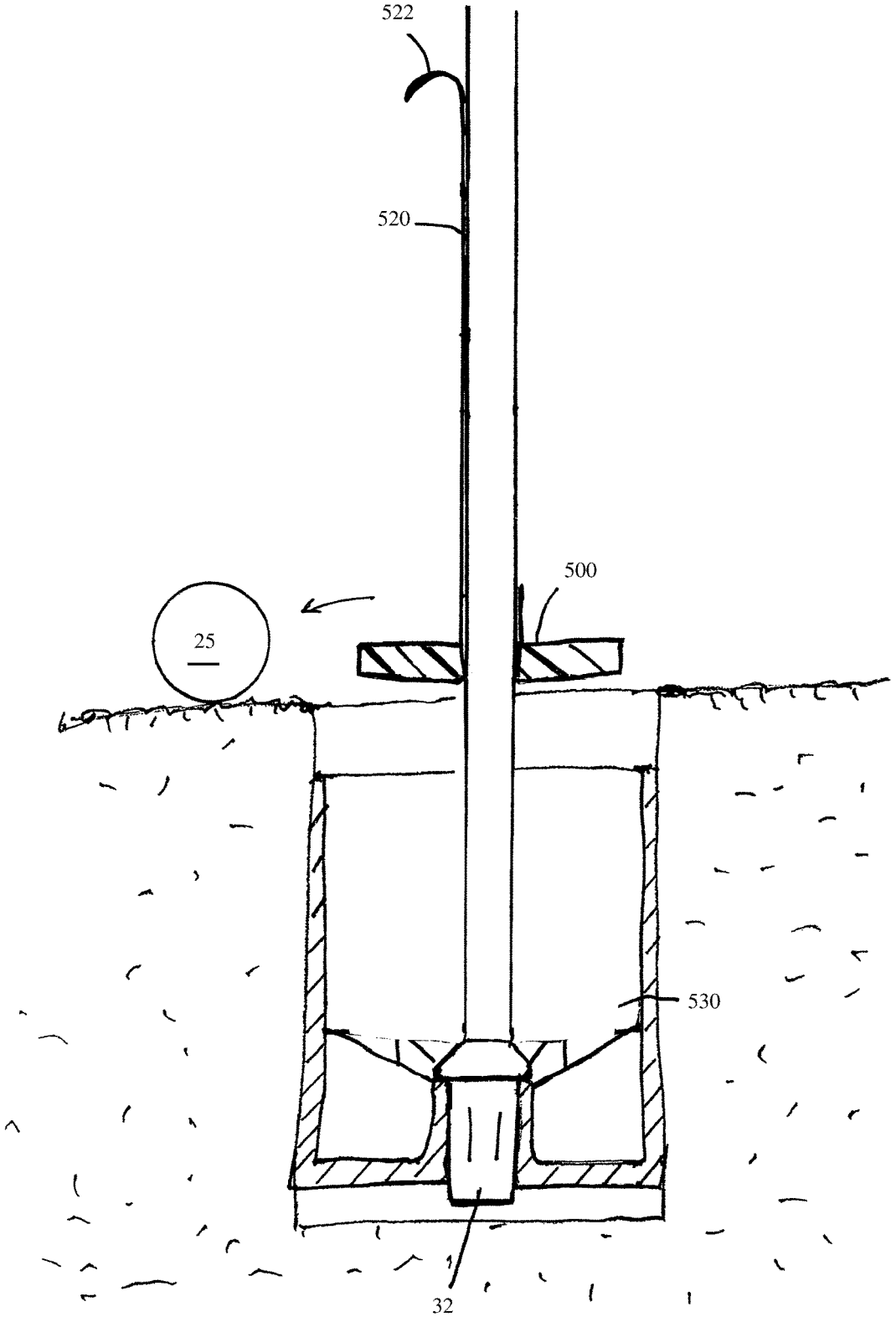
FIG. 43B is the embodiment of FIG. 43A with the elevator raised and the golf ball discharged.
Figure 43C:
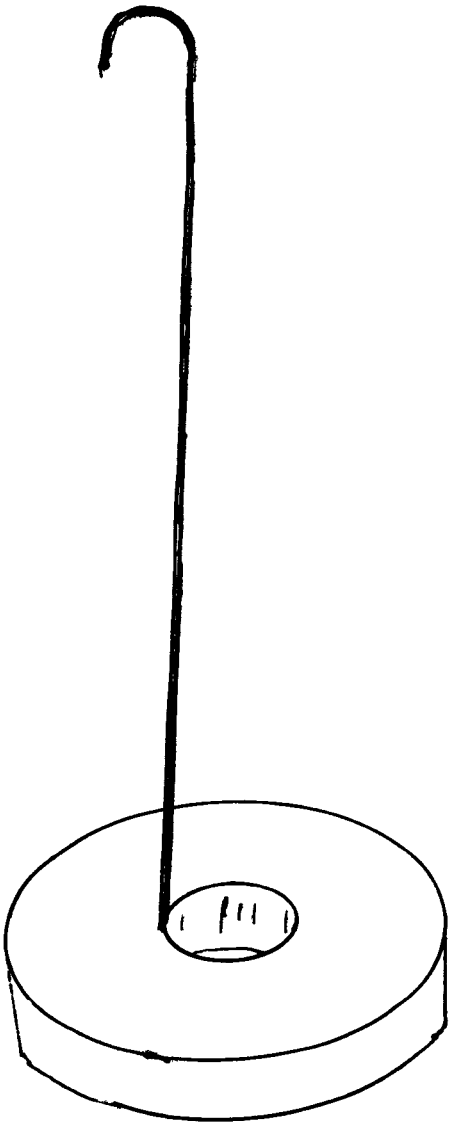
FIG. 43C is a perspective view of the embodiments of FIGS. 43A and 43B.

FIGS. 43A-43C illustrate a golfball lifting device 500 with a thin self supporting elongate member 520 with a hook portion 522 extending up from the elevator 530. The thin elongate member may be a polymer strip or metal or other material. The hook may be replaced with a loop or a magnet or ferrous material to be attracted to a magnet. The hook may be positioned above the putting surface a few inches or more such that it may be caught with a golf club 532 to allow removal of the golf ball without manual contact with the flagstick or lifting device. The device may be raised so that the ball rolls off of the elevator on to the green surface. The hook may be for example less than 12 inches above the green surface 21.

Figure 45:
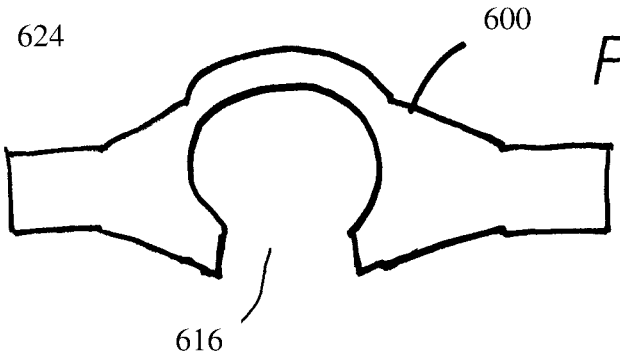
FIG. 45 is a top plan view of the hooked handle of FIG. 44.
Figure 44:
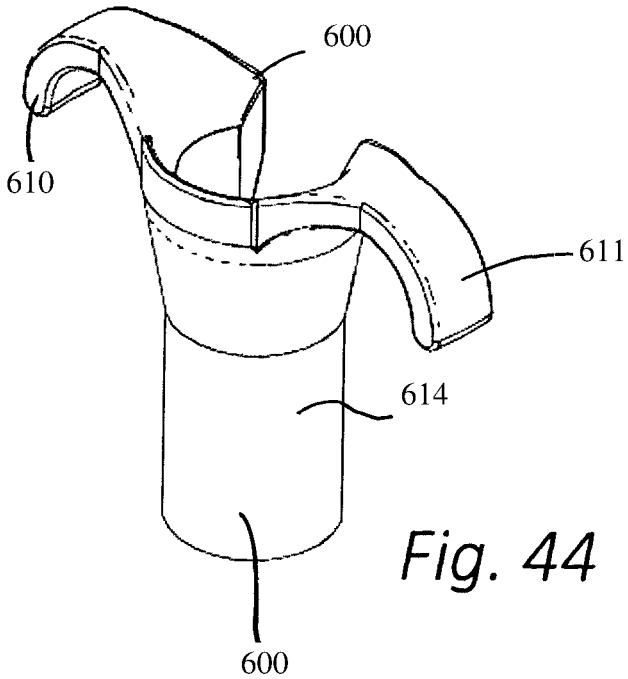
FIG. 44 is a perspective view of a hooked handle for attachment to a lifting device.
Figure 46:
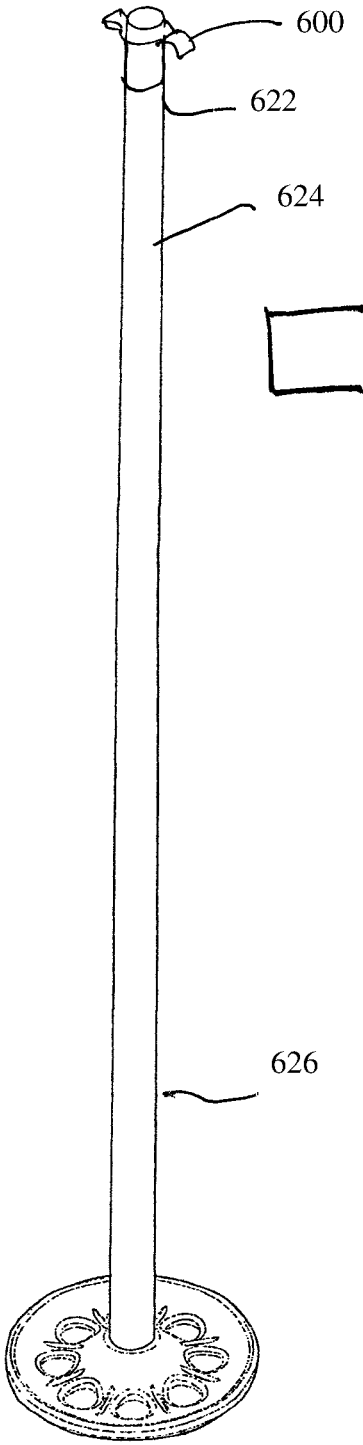
FIG. 46 is a perspective view of a lifting device for a flagstick with the hooded handle of FIGS. 44 and 45.

FIGS. 44, 45 and 46 illustrate a snap-on handle 600 that may be attached to the tubular handles of the lifting devices disclosed herein, for example the embodiments of FIGS. 24-27. The handle has a pair of hook portions 610, 611 attached to a body portion 614 with a forward opening 616 that can be pushed over the upper portion 622 of a tubular handle 624, thereby readily allowing the golfer to utilize a club to engage a hook portion and raise the lifting device 626 without manually touching the flagstick or lifting device. In other embodiments the handle can be unitary with the tubular portion or attached with other known attachment means.

U.S. Pat. Nos. 1,402,026, 1,599,734, 1,673,852, 1,676,954, 1,776,161, 1,826,641, 1,829,283, 1,918,994, 1,943,610, 3,180,644, 3,348,797, 3,543,603, 3,792,861, 3,874,665, 3,897,059, 4,290,603, 4,114,879, 4,360,200, 4,496,150, 4,552,358, 5,393,053, 6,409,609, 6,113,503, 8,740,716 and are incorporated herein for all purposes.

As used herein, a method step recited in the singular and preceded with the word "a" or "an" should be understood as not excluding plural of said steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A lifting device for lifting balls out of a golf hole in combination with a flagstick, the flagstick having a pole portion with an outside diameter of 0.50 to 0.55 inches and a length of at least about seven feet, the flagstick further having a metal ferrule at the bottom end of the pole portion for seating the flagstick in a socket in a cup defining a golf hole and having a flag at a top portion of the pole portion, the lifting device comprising a disk shaped elevator portion loosely positioned about the pole, the disk shaped elevator having seating position on or just above the ferrule and vertically slidable on the pole, the lifting device further having a handle connection to the disk shaped elevator and extending upwardly along the pole portion, the handle having a hook at an upper end of the handle, whereby when the flagstick is in the cup and a golf ball is on the elevator in the seating position, the elevator is raisable out of and above the golf hole with the golf ball thereon.

2. The lifting device in combination with a flagstick of claim 1, wherein the handle comprises a tubular handle portion and the lifting device has a length of about 2.5 feet to 3.5 feet.

3. The lifting device in combination with a flagstick of claim 2, wherein the hook comprises a snap-on polymer piece with opposing hook portions that attaches to an upper end of the tubular handle portion.

4. The lifting device in combination with a flagstick of claim 2, wherein the tubular handle portion is a thin polymer with a 0.010 to 0.025 inches wall thickness.

5. The lifting device in combination with a flagstick of claim 1, wherein the handle comprises one or more thin strips extending to an upper handle portion.

6. The lifting device in combination with a flagstick of claim 1, wherein the handle comprises at least one thin member extending to an upper handle portion.

7. The lifting device in combination with a flagstick of claim 6, wherein the handle is a self supporting elongate member with a single curve on the upper end of the elongate member defining the hook.

8. The lifting device in combination with a flagstick of claim 7, wherein the curve is positioned a few inches above a putting surface when the elevator is in a seated position.

9. The lifting device and combination with a flagstick of any of claim 8, further comprising a polymeric foam member having a cylindrical shape with a central bore positioned on the elevator with the pole portion extending through the central bore.

10. A method of removing a golf ball from the annular space between a wall of a metal cup of a golf hole and the flagstick, the golf hole having a diameter of about 4 and ¼ inches, an upper edge of a the cup being recessed from a green surface at least about an inch, the cup having a central socket at a lower end of the cup, the flagstick having a pole portion with an outside diameter of 0.50 to 0.55 inches and a length of at least about seven feet, a lower end of the pole portion fixed in a ferrule, the ferrule seated in the central socket of the cup, the golf ball resting on a disk shaped elevator slidingly engaged with flagstick, the elevator with a diameter less than a diameter of the cup, a thin member connecting to the disk shaped elevator and extending upwardly along the flagstick and having a hook positioned above the green level, the method comprising:

catching the hook portion of the thin member with a golf club and raising the disk shaped elevator by raising the thin member with the hook portion until the disk shaped member is above the golf hole whereby the golf ball rolls off of the disk shaped elevator.

11. The method of claim 10, wherein, the handle comprises a tubular handle portion and the lifting device has a length of about 2.5 feet to 3.5 feet.

12. The method of claim 10, wherein the handle comprises at least one thin member extending to an upper handle portion, the upper handle portion comprising a hook.

13. The method of claim 12, wherein the hook is positioned a few inches above a putting surface when the elevator is in a seated position.

14. A method of allowing the removal of golf balls from a golf hole with a conventional flagstick therein without removing the flagstick, the conventional flagstick having a pole portion having a diameter of 0.50 to 0.55 inches, a length of at least about seven feet, a flag at the upper end of the pole portion, a ferrule at a lower end of the pole portion, the ferrule sized to be received in a metal cup in the golf hole, the method comprising:

slidably positioning a disk shaped elevator having a diameter less than the golf hole, the elevator having a handle from the elevator toward the upper end of the pole portion;

seating the elevator on the ferrule of the flagstick with the handle extending along the pole portion above a green surface; and positioning a polymeric foam member on the elevator to raise the effective height of the elevator.

* * * * *